United States Patent [19]

Ichijima et al.

[11] Patent Number: 4,985,336

[45] Date of Patent: Jan. 15, 1991

[54] SILVER HALIDE PHOTOGRAPHIC MATERIAL

[75] Inventors: Seiji Ichijima; Keiji Mihayashi, both of Kanagawa, Japan

[73] Assignee: Fuji Photo Film Co., Ltd., Kanagawa, Japan

[21] Appl. No.: 294,957

[22] Filed: Jan. 6, 1989

Related U.S. Application Data

[63] Continuation of Ser. No. 889,146, Jul. 24, 1986, abandoned.

[30] Foreign Application Priority Data

Jul. 24, 1985 [JP] Japan ..... 60-163759

[51] Int. Cl.[5] ..... G03C 8/00; G03C 7/305

[52] U.S. Cl. ..... 430/223; 430/226; 430/505; 430/544; 430/553; 430/555; 430/557; 430/558; 430/957

[58] Field of Search ..... 430/505, 226, 955, 957, 430/958, 959, 544, 552–558, 223

[56] References Cited

U.S. PATENT DOCUMENTS 4,421,845 12/1983 Uemura et al. ..... 430/555
4,438,193 3/1984 Uemura et al. ..... 430/505
4,477,560 10/1984 Koitabashi et al. ..... 430/553
4,482,629 11/1984 Nakagawa et al. ..... 430/544 X
4,618,571 10/1986 Ichijima et al. ..... 430/955 X
4,725,529 2/1988 Shimazaki et al. ..... 430/505
4,770,982 7/1988 Ichijima et al. ..... 430/505

FOREIGN PATENT DOCUMENTS 57138636 2/1981 Japan .
57155537 3/1981 Japan .

*Primary Examiner*—Paul R. Michl
*Assistant Examiner*—Lee C. Wright
*Attorney, Agent, or Firm*—Sughrue, Mion, Zinn, McPeak & Seas

[57] ABSTRACT

A silver halide color photographic light-sensitive material is disclosed, comprising a support having provided thereon at least one red-sensitive silver halide emulsion layer, at least one green-sensitive silver halide emulsion layer and at least one blue-sensitive silver halide emulsion layer, wherein at least one red-sensitive silver halide emulsion layer and at least one green-sensitive silver halide emulsion layer each contains a precursor compound capable of releasing a compound upon reacting with an oxidation product of a developing agent, and said released compound is capable of releasing a development inhibitor upon further reacting with another molecule of the oxidation product of the developing agent. The material has improved sharpness and color reproducibility.

19 Claims, No Drawings

SILVER HALIDE PHOTOGRAPHIC MATERIAL

This is a continuation of application Ser. No. 06/889,146, filed July 24, 1986 now abandoned.

FIELD OF THE INVENTION

This invention relates to a silver halide photographic material, and, more particularly, to a color photographic light-sensitive material having both improved sharpness and improved color reproducibility.

BACKGROUND OF THE INVENTION

Color photographic light-sensitive materials have hitherto been studied widely for the purpose of improving sharpness and color reproducibility. One of the subjects of study is the so-called DIR couplers capable of releasing a development inhibitor.

Useful DIR couplers recently developed include the compounds disclosed, e.g., in U.S. Pat. Nos. 4,248,962, 4,409,323, 4,421,845, 4,438,193 and 4,477,563, etc.

These known DIR couplers exhibit desirable performance properties to some extent. It has been found, however, that they have substantially reached the limits of their possibilities in meeting the demands for further improvement in sharpness and color reproducibility.

SUMMARY OF THE INVENTION

An object of this invention is to provide a color photographic light-sensitive material excellent in sharpness and color reproducibility.

The above object can be accomplished by a silver halide color photographic material comprising a support having provided thereon at least one red-sensitive silver halide emulsion layer, at least one green-sensitive silver halide emulsion layer, and at least one blue-sensitive silver halide emulsion layer, wherein at least one red-sensitive silver halide emulsion layer and at least one green-sensitive silver halide emulsion layer each contains a precursor compound capable of releasing a compound upon reacting with an oxidation product of a developing agent, said released compound being capable of releasing a development inhibitor upon further reacting with another molecule of the oxidation product of the developing agent.

DETAILED DESCRIPTION OF THE INVENTION

The precursor compound characterizing the present invention preferably is a compound represented by formula (I)

$$A-(L_1)_v-B-(L_2)_w-DI \quad (I)$$

wherein A represents a group capable of releasing $(L_1)_v-B-(L_2)_w-DI$ upon reacting with an oxidation product of a developing agent; $L_1$ represents a group capable of releasing $B-(L_2)_w-DI$ after being released from A; B represents a group capable of releasing $(L_2)_w-DI$ upon releasing with an oxidation product of a developing agent after being released from $A-(L_1)_v$; $L_2$ represents a group capable of releasing DI group after being released from B; DI represents a development inhibitor group; and v and w each represents 0 or 1.

The reaction mechanism for the precursor compound represented by formula (I) to release DI upon development can be illustrated by the following reaction scheme:

$$A-(L_1)_v-B-(L_2)_w-DI \xrightarrow{T\oplus} (L_1)_v-B-(L_2)_w-DI$$

$$B-(L_2)_w-DI \xrightarrow{T\oplus} (L_2)_w-DI \longrightarrow DI$$

wherein A, $L_1$, B, $L_2$, DI, v, and w are as defined above; and $T\oplus$ represents an oxidation product of a developing agent.

In the above-described reaction scheme, the reaction of $B-(L_2)_w-DI$ to form $(L_2)_w-DI$ is specially characteristic of excellent effects of the present invention. In detail, this reaction is a second-order reaction between $T\oplus$ and $B-(L_2)_w-DI$, and its reaction rate depends on the concentration of each reactant. Therefore, in areas where $T\oplus$ is produced in a large quantity, $B-(L_2)_w-DI$ rapidly produces $(L_2)_w-DI$ To the contrary, in areas where $T\oplus$ is produced in a small quantity, production of $(L_2)_w-DI$ from $B-(L_2)_w-DI$ is retarded. Such a reaction process combined with the above-described reaction mechanism effectively brings about the desired effects of DI group.

The following reasons would possibly account for the excellence of the present invention in color reproducibility, although applicants do not intend to be bound by such possible explanation.

$(L_1)_v-B-(L_2)_w-DI$ or $B-(L_2)_w-DI$ (which is released from the compound of the formula (I)) present in a green-sensitive layer is diffused throughout the emulsion layer. A part of it produces $(L_2)_w-DI$ within the green-sensitive layer, and another part reaches a different layer, for example, a red-sensitive layer, wherein it produces $(L_2)_w-DI$ in proportion to the concentration of $T\oplus$ that has been formed in the red-sensitive layer. The thus produced $(L_2)_w-DI$ is then converted to DI having a development inhibitory activity, whereby development of the red-sensitive layer is moderately inhibited, to thereby increase color contrast, and to ultimately improve color reproducibility.

Likewise, the above-described mechanism would be applied to $(L_2)_v-B-(L_2)_w-DI$, which has been released from the compound of the formula (I) present in the red-sensitive layer. That is, $B-(L_2)_2-DI$ diffused from the red-sensitive layer into the green-sensitive layer produces $(L_2)_w-DI$ depending on the concentration of $T\oplus$ present in the green-sensitive layer, which ultimately leads to the production of DI group.

On this account, in each layer, the development inhibitory effect exercised by another layer is reasonably controlled in proportion to the $T\oplus$ concentration, i.e., image density, of the respective layer.

The above set forth explanation may be put in another way that the working scope of DI of the compound (I) is controlled by the concentration of $T\oplus$. This is because the working life of $B-(L_2)_w-DI$ vaires with the $T\oplus$ concentration, and the range of diffusion of $B-(L_2)_w-DI$ varies depending on the variation of its working life. This is assumed to also provide an extremely satisfactory effect of improving sharpness. It was confirmed that this effect becomes conspicuous when the compound of formula (I) is present in both the green-sensitive layer and the red-sensitive layer.

The compounds represented by formula (I) are now be described in further detail.

In formula (I), A represents a coupler residue (i.e., a residual group derived from a color coupler) or an oxidation-reduction group. The coupler residue as represented by A is conventional and includes, for example, a yellow coupler residue (e.g., an open-chain ketomethylene coupler residue), a magenta coupler residue (e.g., residues of 5-pyrazolone couplers, pyrazoloimidazole couplers, pyrazolotriazole couplers, etc.), a cyan coupler residue (e.g., residues of phenol couplers, naphthol couplers, etc.) and a colorless coupler residue (e.g., residues of indanone couplers, acetophenone couplers, etc.).

When A represents an oxidation-reduction group, the compounds of formula (I) are preferably represented by formula (II)

$$A_1—P—(X=Y)_n—Q—A_2 \quad (II)$$

wherein P and Q each represents an oxygen atom or a substituted or unsubstituted imino group; X and Y, which may be the same or different, each represents a substituted or unsubstituted methine group or a nitrogen group with the proviso that at least one of X and Y represents a methine group substituted with $—(L_1)_v—B—(L_2)_w—DI$; n represents an integer of from 1 to 3; and $A_1$ and $A_2$ each represents a hydrogen atom or a group releasable by an alkali. Any two of P, X, Y, Q, $A_1$ and $A_2$ may be linked together to form a cyclic structure. For example, $(X=Y)_n$ may form a benzene ring, a pyridine ring, etc.

In formula (I), the groups represented by $L_1$ and $L_2$ are optionally present, and can be selected appropriately according to the intended purposes. Preferable groups for $L_1$ and $L_2$ include the following known linking groups (1) to (3):

(1) Groups which utilize the hemiacetal cleavage reaction. For example, such groups are described in U.S. Pat. No. 4,146,396 and Japanese Patent application (OPI) Nos. 249148/85, 249149/85 and 218645/85, and may be represented by the general formula given below. In the formula, the mark * indicates the position of attachment at the left-hand side of formula (I), and the mark ** indicates the position of attachment at the right-hand side of formula (I).

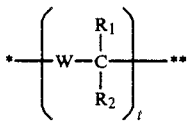

In the above formula, W is an oxygen atom or the group

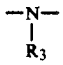

(where $R_3$ is an organic substituent group such as an acyl group (e.g., an acetyl group, a benzoyl group), a sulfonyl group (e.g., a methanesulfonyl group, a benzenesulfonyl group), a sulfamoyl group (e.g., a sulfamoyl group, an N-methylsulfamoyl group), an aliphatic group (e.g., a methyl group, an ethyl group), an aromatic group (e.g., a phenyl group, a naphthyl group), or a carbamoyl group (e.g., an ethylcarbamoyl group, a phenylcarbamoyl group)); $R_1$ and $R_2$ each is a hydrogen atom or a substituent group, preferably the group as described for $R_3$ above; t is 1 or 2 and when t is 2, two occurrences of $R_1$ and $R_2$ may represent the same or different species. Included is the case in which any two of $R_1$, $R_2$ and $R_3$ are combined to form a cyclic structure. The typical example of such case having a cyclic structure is represented by the following formula:

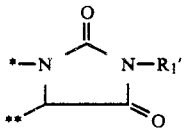

wherein the preferred $R_1'$ represents an aliphatic group having 1 to 5 carbon atoms (e.g., a methyl group, an ethyl group, a butyl group) or a hydrogen atom.

Specific examples of the groups represented by the above formula include the following groups wherein * and ** have the same meaning as above.

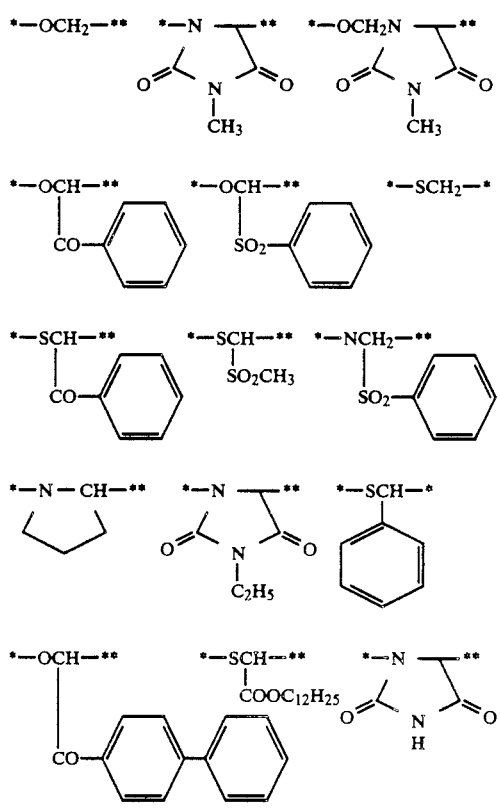

(2) Groups such that cleavage is induced by intramolecular nucleophilic displacement. Examples are the timing groups as described in U.S. Pat. No. 4,248,962.

Specific examples of the groups include the following groups wherein * and ** have the same meaning as above.

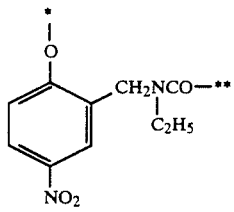

-continued

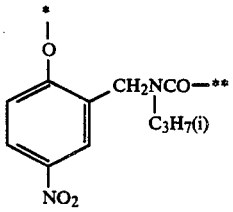

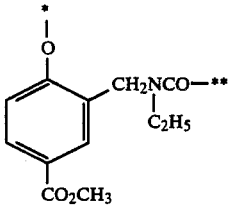

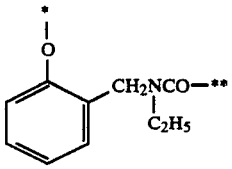

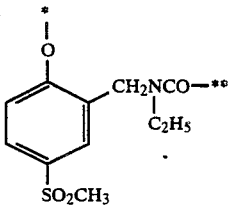

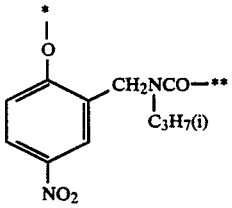

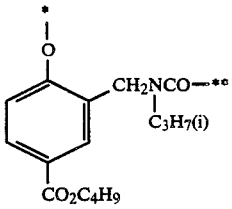

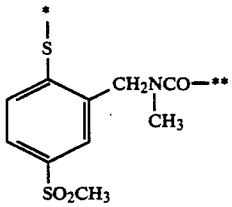

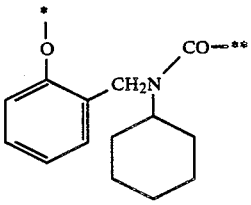

(3) Groups such that cleavage is induced by electron transfer along a conjugated system. Examples include the groups described in U.S. Pat. No. 4,409,323 and the groups of the following general formula (the groups described in British Patent No. 2,096,783A).

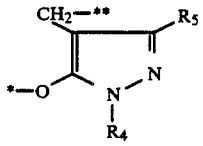

In the above formula, the mark * indicates the position of attachment to at the left hand side of formula (I); the mark ** indicates the position of attachment at the right-hand side of formula (I); and $R_4$ and $R_5$ each is a hydrogen atom or a substituent group. The preferred substituent group of $R_4$ is an aliphatic group (e.g., a methyl group, a benzyl group), or an aromatic group (e.g., a phenyl group, a 2,4,6-trichlorophenyl group), and the preferred substituent group of $R_5$ is an aliphatic group (e.g., a methyl group, an ethyl group), an aromatic group (e.g., a phenyl group, a 4-methoxyphenyl group), or an alkoxycarbonyl group (e.g., a methoxycarbonyl group, an ethoxycarbonyl group), an alkoxy group (e.g., a methoxy group, a benzyloxy group), a carbonamido group (e.g., an acetamido group, a benzamido group), a carbamoyl group (e.g., an N-phenylcarbamoyl group, an N-octylcarbamoyl group), or a cyano group.

Specific examples of the groups include the following group wherein * and ** have the same meanings as above.

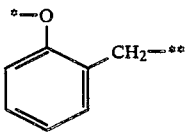

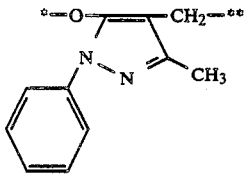

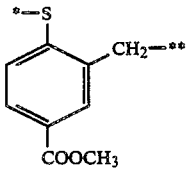

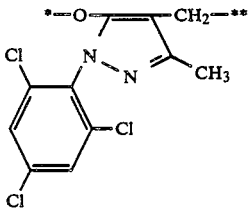

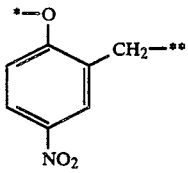

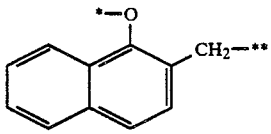

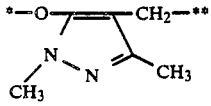

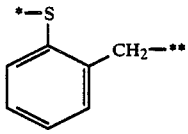

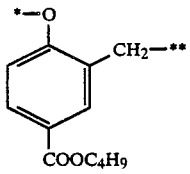

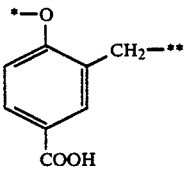

-continued

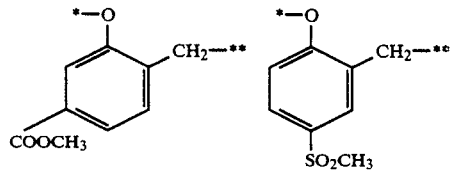

The group as represented by B in formula (I) specifically includes a group which is released from A—$(L_1)_v$ as a coupler, or a group which is released from A—$(L_1)_v$ as an oxidation-reduction group. The former group includes, for example, a phenol coupler residue which is bonded to A $(L_1)_v$ via its oxygen atom of the hydroxyl group from which a hydrogen atom is removed, and a 5-pyrazolone coupler residue bonded to A—$(L_1)_v$ via its oxygen atom of the hydroxyl group tautomerized in the form of a 5-hydroxypyrazole, from which a hydrogen atom is removed. These groups do not become couplers, e.g., phenol couplers or 5-pyrazolone couplers until they are released from A—$(L_1)_v$. The thus released coupler carries $(L_2)_w$—DI at the coupling position thereof.

When B represents a group which becomes an oxidation-reduction group, it is represented by formula (B-1)

$$*—P—(X'=Y')_n—Q—A_2 \qquad (B—1)$$

wherein * indicates the position for bonding to A—$(L_1)_v$; $A_2$, P, Q, and n are as defined above; X' and Y' each represents a substituted or unsubstituted methine group or a nitrogen group, provided that at least one of them is a methine group substituted with $(L_2)_w$—DI; and any two of $A_2$, P, Q, X' and Y' may be linked together to form a cyclic structure, for example, a benzene ring.

DI in formula (I) specifically includes a 5-aromatic group-substituted tetrazolylthio group, a 5-aliphatic group-substituted tetrazolylthio group, a benzimidazolylthio group, a benzothiazolylthio group, a benzoxazolylthio group, a benzotriazolyl group, a benzoindazolyl group, etc. These groups may have appropriate substituents. For example, development inhibitors include those described in U.S. Pat. Nos. 4,477,563, 4,500,634, 4,157,916, 4,500,633 and 4,248,962.

The compounds of formula (I) according to the present invention include those wherein any two selected from A, $L_1$, B, $L_2$ and DI are connected to each other through a bond in addition to the bond or bonds shown in the formula (I). The effects of the present invention can be exerted even if this additional bond is not cleaved. Examples of such bondings are shown below:

A $(L_1)_v$ B—$(L_2)_w$—DI

A—$(L_1)_v$—B $(L_2)_w$ DI

A—$(L_1)_v$—B—$L_2$—DI

-continued

A—$L_1$—B—$(L_2)_w$—DI

The compounds represented by formula (I) are further illustrated below with respect to preferred embodiments.

Among the coupler residues as represented by A, preferred are those represented by the following formulae (Cp-1) through (Cp-11). These coupler residues exhibit a high coupling rate.

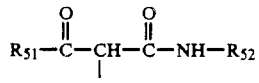

(Cp-1)

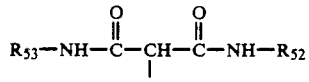

(Cp-2)

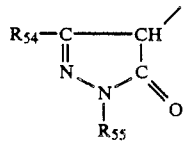

(Cp-3)

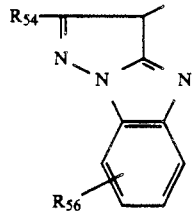

(Cp-4)

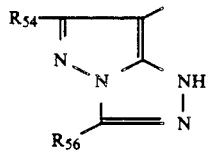

(Cp-5)

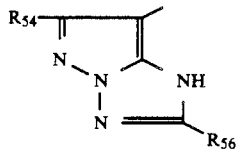

(Cp-6)

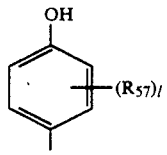

(Cp-7)

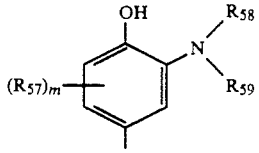

(Cp-8)

-continued

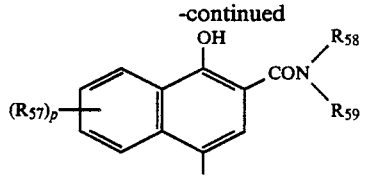

(Cp-9)

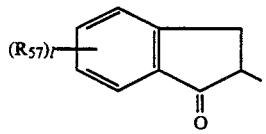

(Cp-10)

$R_{60}$—CH—$R_{61}$ (Cp-11)

In the above formulae, the free bond extended from the coupling position indicates a position at which a coupling releasable group is bonded. When $R_{51}$, $R_{52}$, $R_{53}$, $R_{54}$, $R_{55}$, $R_{56}$, $R_{57}$, $R_{58}$, $R_{59}$, $R_{60}$ or $R_{61}$ contains a ballast group, it is selected so as to have a total carbon atom number of from 8 to 32, and preferably from 10 to 22. In other cases, it preferably contains not more than 15 carbon atoms in total.

In the above-described formulae (Cp-1) through (Cp-11), $R_{51}$ represents an aliphatic group, an aromatic group, an alkoxy group or a heterocyclic group; and $R_{52}$ and $R_{53}$ each represents an aromatic group or a heterocyclic group.

The aliphatic group as represented by $R_{51}$ may be substituted or unsubstituted, and acyclic or cyclic, and preferably contains from 1 to 22 carbon atoms. Substituents for alkyl groups preferably include a substituted or unsubstituted alkoxy group, a substituted or unsubstituted aryloxy group, a substituted or unsubstituted amino group, a substituted or unsubstituted acylamino group, a halogen atom, etc. Specific examples of useful aliphatic groups for $R_{51}$ include an isopropyl group, an isobutyl group, a t-butyl group, an isoamyl group, a t-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-t-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

When $R_{51}$, $R_{52}$, or $R_{53}$ represents an aromatic group, and particularly a phenyl group, the aromatic group, such as a phenyl group, may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, etc., each of these substituents containing not more than 32 carbon atoms. The alkyl moiety of these substituents may contain in its chain an aromatic group, such as a phenylene group. The phenyl group may be substituted with an aryloxy group, an aryloxycarbonyl group, an arylcarbamoyl group, an arylamido group, an arylsulfamoyl group, an arylsulfonamido group, an arylureido group, etc., wherein the aryl moiety may further be substituted with one or more alkyl groups each having from 1 to 22 carbon atoms.

The phenyl group as represented by $R_{51}$, $R_{52}$, or $R_{53}$ may be substituted with an amino group, an amino group substituted with a lower alkyl group having from 1 to 6 carbon atoms, a hydroxyl group, a carboxyl group, a sulfo group, a nitro group, a cyano group, a thiocyano group, or a halogen atom.

$R_{51}$, $R_{52}$ or $R_{53}$ may further represents a phenylcondensed ring, such as a naphthyl group, a quinolyl group, an isoquinolyl group, a chromanyl group, a coumaranyl group, a tetrahydronaphthyl group, etc. These condensed rings may be further substituted with the substituent as described for $R_{51}$, $R_{52}$ and $R_{53}$.

When $R_{51}$ represents an alkoxy group, the alkyl moiety thereof represents a straight chain or branched alkyl group, an alkenyl group, a cyclic alkyl group, or a cyclic alkenyl group, having from 1 to 32, and preferably from 1 to 22, carbon atoms. These groups may be substituted with a halogen atom, an aryl group, an alkoxy group, etc.

When $R_{51}$, $R_{52}$, or $R_{53}$ represents a heterocyclic group, the heterocyclic group is bonded to a carbon atom of the carbonyl group of the acyl group or a nitrogen atom of the amido group of the α-acylacetamide via one of the carbon atoms constituting the ring. Examples of the heterocyclic ring include thiophene, furan, pyran, pyrrole, pyrazole, pyridine, pyrazine, pyrimidine, pyridazine, indolizine, imidazole, thiazole, oxazole, triazine, thiadiazine, oxazine, etc. These heterocyclic groups may have a substituent on the ring thereof.

In the formula (Cp-3), $R_{55}$ represents a substituted or unsubstituted straight chain or branched alkyl group (e.g., a methyl group, an isopropyl group, a t-butyl group, a hexyl group, a dodecyl group, etc.), a substituted or unsubstituted alkenyl group (e.g., an allyl group), a substituted or unsubstituted cyclic alkyl group (e.g., a cyclopentyl group, a cyclohexyl group, a norbornyl group, etc.), a substituted or unsubstituted aralkyl group (e.g., a benzyl group, a β-phenylethyl group, etc.) or a cyclic alkenyl group (e.g., a cyclopentenyl group, a cyclohexenyl group, etc.), having from 1 to 32 carbon atoms, and preferably from 1 to 22 carbon atoms. The substituents for these groups include a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, a mercapto group, etc.

$R_{55}$ further represents an aryl group (e.g., a phenyl group, an α- or β-naphthyl group, etc.) or an aryl group having one or more substituents. The substituents for the aryl group include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, an ureido group, an urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group, etc.

$R_{55}$ may furthermore represent a heterocyclic group (such as a 5- or 6-membered heterocyclic or condensed heterocyclic groups containing a nitrogen atom, an oxygen atom, or a sulfur atom as a hetero atom, e.g., a pyridyl group, a quinolyl group, a furyl group, a benzothiazolyl group, an oxazolyl group, an imidazolyl group, a naphthoxazolyl group, etc.), a heterocyclic group substituted with a substituent as recited for the above-described aryl group, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

$R_{54}$ represents a hydrogen atom, a straight or branched alkyl, alkenyl, cyclic alkyl, aralkyl or cyclic alkenyl group (these groups may have substituents as recited for $R_{55}$), an aryl or heterocyclic group which may have substituents as recited for $R_{55}$, an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxyl group, an acylamino group (e.g., an acetylamino group, a 3-[(2,4-di-t-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethyl-carbamoyl group, an N-methyl-phenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxyl group or a sulfo group, having from 1 to 32 carbon atoms, and preferably from 1 to 22 carbon atoms.

$R_{56}$ represents a hydrogen atom or a substituted or unsubstituted, straight chain or branched alkyl, alkenyl, cyclic alkyl, aralkyl or cyclic alkenyl group having from 1 to 32 carbon atoms, and preferably from 1 to 22 carbon atoms. The substituents therefor are the same as recited for $R_{55}$.

$R_{56}$ further represents a substituted or unsubstituted aryl group or a substituted or unsubstituted heterocyclic group. The substituents therefor are the same as cyclic group. The substituents therefor are the same as recited for $R_{55}$.

$R_{56}$ furthermore represents a cyano group, an alkoxy group, an aryloxy group, a halogen atom, a carboxyl group, an alkoxycarbonyl group, an aryloxycarbonyl group, an acyloxy group, a sulfo group, a sulfamoyl group, a carbamoyl group, an acylamino group, a diacylamino group, an ureido group, an urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group or a hydroxyl group.

$R_{57}$, $R_{58}$, and $R_{59}$ each represents a group generally employed in usual 4-equivalent phenol or α-naphthol couplers. Specifically, $R_{57}$ includes a hydrogen atom, a halogen atom, an alkoxycarbonylamino group, an aliphatic hydrocarbon group, a sulfonamido group, an N-arylureido group, an acylamino group, —O—$R_{62}$ and —S—$R_{62}$, wherein $R_{62}$ represents an aliphatic hydrocarbon group. When there are two or more $R_{57}$ groups per molecule, they may be the same or different. The above-recited aliphatic hydrocarbon residual group may have a substituent.

When these substituents contain an aryl group, such an aryl group may have substituents as recited for $R_{55}$.

$R_{58}$ and $R_{59}$ specifically include groups selected from aliphatic hydrocarbon groups, aryl groups, and heterocyclic groups. Either one of $R_{58}$ and $R_{59}$ may be a hydrogen atom. These groups may have substituents. $R_{58}$ and $R_{59}$ may together form a nitrogen-containing heterocyclic nucleus.

The aliphatic hydrocarbon group as represented by $R_{58}$ or $R_{59}$ may be saturated or unsaturated and may be a straight chain, branched, or cyclic group. Examples of preferred aliphatic hydrocarbon groups are an alkyl group (e.g., a methyl group, an ethyl group, a propyl group, an isopropyl group, a butyl group, a t-butyl group, an isobutyl group, a dodecyl group, an octadecyl group, a cyclobutyl group, a cyclohexyl group, etc.) and an alkenyl group (e.g., an allyl group, an octenyl group, etc.). Typical examples of the aryl group for $R_{58}$ or $R_{59}$ include a phenyl group, a naphthyl group, etc. Typical examples of the heterocyclic group for $R_{58}$ or $R_{59}$ include a pyridinyl group, a quinolyl group, a thienyl group, a piperidyl group, an imidazolyl group, etc. Substituents that may be introduced into the above-described aliphatic hydrocarbon groups, aryl groups, and heterocyclic groups include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

l represents an integer of from 1 to 4; m represents an integer of from 1 to 3; and p represents an integer of from 1 to 5.

$R_{60}$ represents a substituted or unsubstituted arylcarbonyl group, a substituted or unsubstituted alkanoyl group having from 2 to 32, and preferably from 2 to 22, carbon atoms, a substituted or unsubstituted arylcarbamoyl group, a substituted or unsubstituted alkanecarbamoyl group having from 2 to 32, and preferably from 2 to 22, carbon atoms, a substituted or unsubstituted alkoxycarbonyl group having from 1 to 32, and preferably from 1 to 22, carbon atoms or a substituted or unsubstituted aryloxycarbonyl group. Substituents for these groups include an alkoxy group, an alkoxycarbonyl group, an acylamino group, an alkylsulfamoyl group, an alkylsulfonamido group, an alkylsuccinimido group, a halogen atom, a nitro group, a carboxyl group, a nitrile group, an alkyl group, an aryl group, etc.

$R_{61}$ represents a substituted or unsubstituted arylcarbonyl group, a substituted or unsubstituted alkanoyl group having from 2 to 32, and preferably from 2 to 22, carbon atoms, a substituted or unsubstituted arylcarbamoyl group, a substituted or unsubstituted alkanecarbamoyl group having from 2 to 32, and preferably from 2 to 22, carbon atoms, a substituted or unsubstituted alkoxycarbonyl group having from 1 to 32, and preferably from 1 to 22, carbon atoms, a substituted or unsubstituted aryloxycarbonyl group, a substituted or unsubstituted alkylsulfonyl group having from 1 to 32, and preferably from 1 to 22, carbon atoms, a substituted or unsubstituted arylsulfonyl group, a substituted or unsubstituted aryl group or a substituted or unsubstituted 5- or 6-membered heterocyclic group having a nitrogen atom, an oxygen atom, or a sulfur atom as a hetero atom, e.g., a triazolyl group, an imidazolyl group, a phthalimido group, a succinimido group, a furyl group, a pyridyl group or a benzotriazolyl group. Substituents for these groups are the same as recited for $R_{60}$.

Among the above-described coupler residues, preferred as yellow coupler residues are (Cp-1) wherein $R_{51}$ represents a t-butyl group or a substituted or unsubstituted aryl group, and $R_{52}$ represents a substituted or unsubstituted aryl group; and (Cp-2) wherein $R_{52}$ and $R_{53}$ each represents a substituted or unsubstituted aryl group.

Preferred as magenta coupler residues are (Cp-3) wherein $R_{54}$ represents an acylamino group, an ureido group, or an arylamino group, and $R_{55}$ represents a substituted aryl group; (Cp-4) wherein $R_{54}$ represents an acylamino group, an ureido group, or an arylamino group, and $R_{56}$ represents a hydrogen atom; and (Cp-5) and (Cp-6) wherein $R_{54}$ and $R_{56}$ each represents a straight chain or branched alkyl group, an alkenyl group, a cyclic alkyl group, an aralkyl group, or a cyclic alkenyl group.

Preferred as cyan coupler residues are (Cp-7) wherein l represents 3, and $R_{57}$ represents an acylamino group or an ureido group at the 2-position, an acylamino group or an alkyl group at the 5-position and a hydrogen atom or a chlorine atom at the 6-position; and (Cp-9) wherein $R_{57}$ represents a hydrogen atom, an acylamino group, a sulfonamido group or an alkoxycarbonylamino group at the 5-position, $R_{58}$ represents a hydrogen atom, and $R_{59}$ represents a phenyl group, an alkyl group, an alkenyl group, a cyclic alkyl group, an aralkyl group or a cyclic alkenyl group.

Preferred as colorless coupler residues are (Cp-10) wherein $R_{57}$ represents an acylamino group, a sulfonamido group or a sulfamoyl group; and (Cp-11) wherein $R_{60}$ and $R_{61}$ each represents an alkoxycarbonyl group.

The formulae (Cp-1) to (Cp-11) may be in the form of polymer, inclusive of bis-compound, formed at any of $R_{51}$ to $R_{61}$. Such a polymer may be a homopolymer comprising a monomer having an ethylenically unsaturated group at any of $R_{51}$ to $R_{61}$ or a copolymer comprising such a monomer and a noncolor forming monomer.

The oxidation-reduction group as represented by A, and particularly by the formula (II), is described below.

In formula (II), when P and Q each represents a substituted or unsubstituted imino group, such a group preferably includes an imino group substituted with a sulfonyl group as represented by the following formula (N-1) and an imino group substituted with an acyl group as represented by the following formula (N-2)

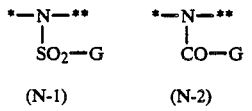

(N-1) (N-2)

wherein * indicates a position for bonding to $A_1$ or $A_2$; ** indicates a position for bonding to one of the free bonds of $-(X{\equiv}Y)_n-$; and G preferably represents a straight chain, branched, or cyclic, saturated or unsaturated, and substituted or unsubstituted aliphatic group having from 1 to 32 carbon atoms, and preferably from 1 to 22 carbon atoms (e.g., a methyl group, an ethyl group, a benzyl group, a phenoxybutyl group, an isopropyl group, etc.), a substituted or unsubstituted aromatic group having from 6 to 10 carbon atoms (e.g., a phenyl group, a 4-methylphenyl group, a 1-naphthyl group, a 4-dodecyloxyphenyl group, etc.) or a 4- to 7-membered heterocyclic group having a hetero atom selected from nitrogen, sulfur, and oxygen atoms (e.g., a 2-pyridyl group, a 1-phenyl-4-imidazolyl group, a 2-furyl group, a benzothienyl group, etc.).

When $A_1$ and $A_2$ each represents a group which can be released by an alkali (hereinafter referred to as "precursor group"), examples of such a precursor group preferably include hydrolyzable groups, such as an acyl group, an alkoxycarbonyl group, an aryloxycarbonyl group, a carbamoyl group, an imidoyl group, an oxazolyl group, a sulfonyl group, etc.; precursor groups releasable by utilizing reverse Michael reaction as described in U.S. Pat. No. 4,009,029; precursor groups releasable by utilizing an anion produced after ring cleavage as an intramolecular nucleophilic group as described in U.S. Pat. No. 4,310,612; precursor groups releasable by electron transfer of an anion through a conjugated system as described in U.S. Pat. Nos. 3,674,478, 3,932,480 and 3,993,661; precursor groups releasabale by electron transfer of an produced after ring cleavage as described in U.S. Pat. No. 4,335,200; and precursor groups utilizing an imidomethyl group as described in U.S. Pat. No. 4,363,865 and 4,410,618.

Of the groups represented by the formula (II), preferred are those wherein P represents an oxygen atom, and $A_2$ represents a hydrogen atom.

Most preferred among the groups represented by formula (II) are those represented by formulae (III) and (IV):

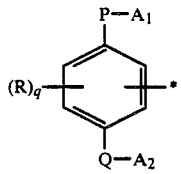

(III)

-continued (IV)

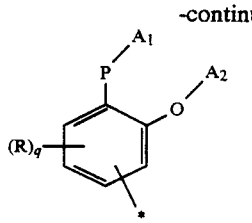

wherein * indicates a position at which $(L_1)_v$—B—$(L_2)_w$—DI is bonded; P, Q, $A_1$ and $A_2$ are as defined above; R represents a cyano group, an alkoxycarbonylamino group, an aliphatic hydrocarbon group, an N-arylureido group, an acylamino group, an alkoxy group, an aryloxy group, an alkylthio group or an arylthio group; and q represents an integer of from 0 to 3. When q is 2 or more, the two or more R substituents are the same or different. When two substituents R are on carbon atoms adjacent to each other, they may together form a cyclic structure. Such being the case, they can form a benzene condensed ring, such as a naphthalene ring, a benzonorbornene ring, a cumarone ring, an indole ring, a benzothiophene ring, a quinoline ring, a benzofuran ring, a 2,3-dihydrobenzofuran ring, an indane ring, an indene ring, etc. which may have one or more substituents. Examples of the substituents of these condensed rings and examples of R which is not in the form of a condensed ring include an aliphatic group (e.g., a methyl group, an ethyl group, an allyl group, a benzyl group, a dodecyl group, etc.), an aromatic group (e.g., a phenyl group, a naphthyl group, a 4-phenoxycarbonylphenyl group, etc.), a halogen atom (e.g., a chlorine atom, a bromine atom, etc.), an alkoxy group (e.g., a methoxy group, a hexadecyloxy group, etc.), an alkylthio group (e.g., a methylthio group, a dodecylthio group, a benzylthio group, etc.), an aryloxy group (e.g., a phenoxy group, a 4-t-octylphenoxy group, a 2,4-di-t-amylphenoxy group, etc.), an arylthio group (e.g., a phenylthio group, a 4-dodecyloxyphenylthio group, etc.), a carbamoyl group (e.g., an N-ethylcarbamoyl group, an N-hexadecylcarbamoyl group, an N-3-(3,4-di-t-amylphenoxy)propylcarbamoyl group, an N-methyl-N-octadecylcarbamoyl group, etc.), an alkoxycarbonyl group (e.g., a methoxycarbonyl group, a 2-cyanoethoxycarbonyl group, an ethoxycarbonyl group, a dodecyloxycarbonyl group, a 3-(2,4-di-t-amylphenoxy)propoxycarbonyl group, etc.), an aryloxycarbonyl group (e.g., a phenoxycarbonyl group, a 4-nonylphenoxycarbonyl group, etc.), a sulfonyl group (e.g., a methanesulfonyl group, a benzenesulfonyl group, a p-toluenesulfonyl group, etc.), a sulfamoyl group (e.g., an N-propylsulfamoyl group, an N-methyl-N-octadecylsulfamoyl group, an N-phenylsulfamoyl group, an N-dodecylsulfamoyl group, etc.), an acylamino group (e.g., an acetamido group, a benzamido group, a tetradecanamido group, a 4-(2,4-di-t-amylphenoxy)butanamido group, a 2-(2,4-di-t-amylphenoxy)butanamido group, a 2-(2,4-di-t-amylphenoxy)tetradecanamido group, etc.), a sulfonamido group (e.g., a methanesulfonamido group, a benzenesulfonamido group, a hexadecylsulfonamido group, etc.), an acyl group (e.g., an acetyl group, a benzoyl group, a myristoyl group, a palmitoyl group, etc.), a nitroso group, an acyloxy group (e.g., an acetoxy group, a benzoyloxy group, a lauryloxy group, etc.), an ureido group (e.g., a 3-phenylureido group, a 3-(4-cyanophenylureido group, etc.), a nitro group, a cyano group, a 4- to 6-membered heterocyclic group having a hetero atom selected from nitrogen, oxygen, and sulfur atoms (e.g., a 2-furyl group, a 2-pyridyl group, a 1-imidazolyl group, a 1-morpholino group, etc.), a hydroxyl group, a carboxyl group, an alkoxycarbonylamino group (e.g., a methoxycarbonylamino group, a phenoxycarbonylamino group, a dodecyloxycarbonylamino group, etc.), a sulfo group, an amino group, an arylamino group (e.g., an anilino group, a 4-methoxycarbonylanilino group, etc.), an aliphatic amino group (e.g., an N,N-diethylamino group, a dodecylamino group, etc.), a sulfinyl group (e.g., a benzenesulfinyl group, a propylsulfinyl group, etc.), a sulfamoylamino group (e.g., a 3-phenylsulfamoyl group, etc.), a thioacyl group (e.g., a thiobenzoyl group, etc.), an ureido group (e.g., a 3-phenylthioureido group, etc.), a heterocyclic thio group (e.g., a thiadiazolylthio group, etc.), an imido group (e.g., a succinimido group, a phthalimido group, an octadecenylimido group, etc.), a heterocyclic amino group (e.g., a 4-imidazolylamino group, a 4-pyridylamino group, etc.), and the like.

When the above-described substituents contain an aliphatic moiety, such an aliphatic group generally has from 1 to 32 carbon atoms, and preferably from 1 to 20 carbon atoms, and may be acylic or cylic, straight or branched, saturated or unsaturated, and substituted or unsubstituted.

When the above-enumerated substituents contain an aromatic group, such an aromatic group contains from 6 to 10 carbon atoms, and preferably includes a substituted or unsubstituted phenyl group.

In formula (II), B is preferably represented by the formula (B-1) as hereinbefore given.

In the formula (B-1), P preferably represents an oxygen atom, and Q preferably represents an oxygen atom or a group having the formula

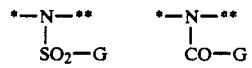

wherein G is as defined above.

It is particularly preferable in terms of the effects of the present invention that B in formula (I) is represented by the formula (B-2) or (B-3)

(B-2)

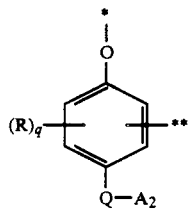

(B-3)

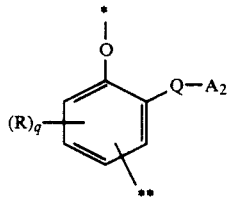

wherein * indicates a position for bonding to A—$L_1$—$_v$; ** indicates a position for bonding to ($L_2$—$_w$—DI; and R, q, Q and $A_2$ are as defined above.

In formula (I), examples of preferred DI include a substituted or unsubstituted tetrazolylthio group having an aromatic group, preferably having from 6 to 10 carbon atoms, or an aliphatic group, preferably the one having from 1 to 10 carbon atoms, at the 5-position thereof and a substituted or unsubstituted benzotriazolyl group. The substituents for these groups are selected from those enumerated for R of the formulae (III) and (IV).

In the formula (I), v and w both preferably represent 0, and A preferably represents a coupler residue.

Compounds to be incorporated into a red-sensitive emulsion layer preferably include those of the formula (I) wherein A represents a coupler residue of the formula (Cp-7), (Cp-8) or (Cp-9).

Compounds to be incorporated into a green-sensitive emulsion layer preferably include those of the formula (I) wherein A represents a coupler residue of the formula (Cp-3), (Cp-6), (Cp-7), (Cp-8) or (Cp-9), and more preferably those wherein A represents a coupler residue of the formula (Cp-3) or (Cp-6).

The compounds of the present invention may optionally be used in a blue-sensitive emulsion layer, but if used, preferred compounds are those wherein A represents a coupler residue of (Cp-1), (Cp-2), (Cp-7), (Cp-8), or (Cp-9). In addition, the blue-sensitive emulsion layer may contain other known DIR couplers, such as those described in U.S. Pat. Nos. 4,477,563, 4,248,962, 4,409,323, and 4,421,845.

The compounds of formula (I) in accordance with the present invention can be applied to multilayer multicolor photographic materials having at least three layers having different spectral sensitivity on the same support with the main purpose of improving sharpness and color reproducibility. Multilayer natural color photographic materials generally comprise a support having provided thereon at least one red-sensitive emulsion layer, at least one green-sensitive emulsion layer and at least one blue-sensitive emulsion layer. The order of these layers can arbitrarily be selected according to necessity. The compounds of the present invention can be used in an optional layer, such as a high-sensitive layer or a moderate-sensitive layer, etc. Further, they may be used in light-sensitive silver halide emulsion layers or layers adjacent thereto.

The amounts of the compounds of this invention vary depending on their structures and the end use, but preferably range from $1\times10^{-7}$ to 0.5 mol, and more preferably from $1\times10^{-6}$ to $1\times10^{-1}$ mol, per mole of silver present in the same layer to which they are used, or in an adjacent layer.

The compounds according to the present invention may be used in a layer either alone or in combination with known couplers. In cases when they are used in combination with other color image forming couplers, a molar ratio of the compounds of the invention to the other color image forming coupler is generally from 0.1/99.9 to 90/10, and preferably from 1/99 to 50/50.

Specific but non-limiting examples of the compounds according to the present invention are shown below.

(1)

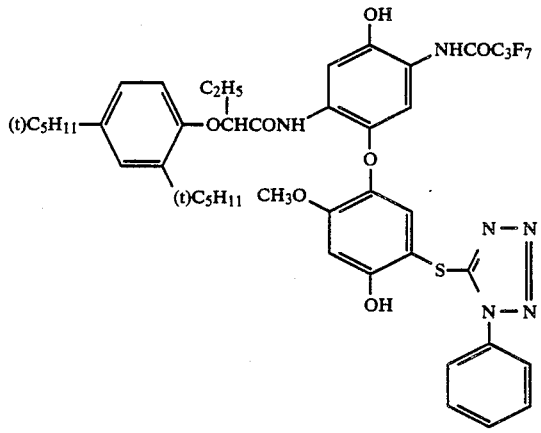

(2)

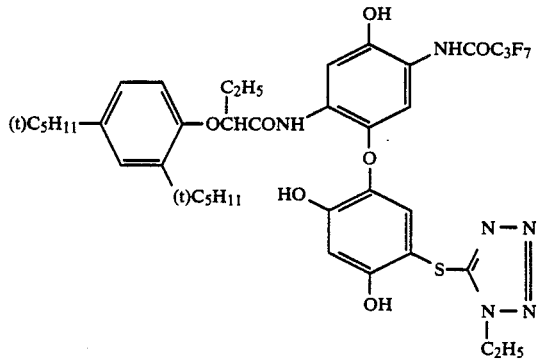

-continued
(3)
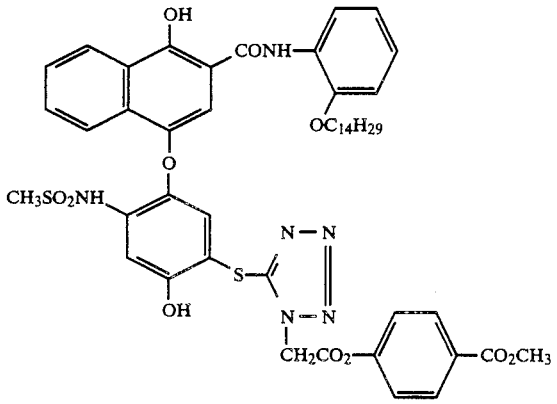
(4)
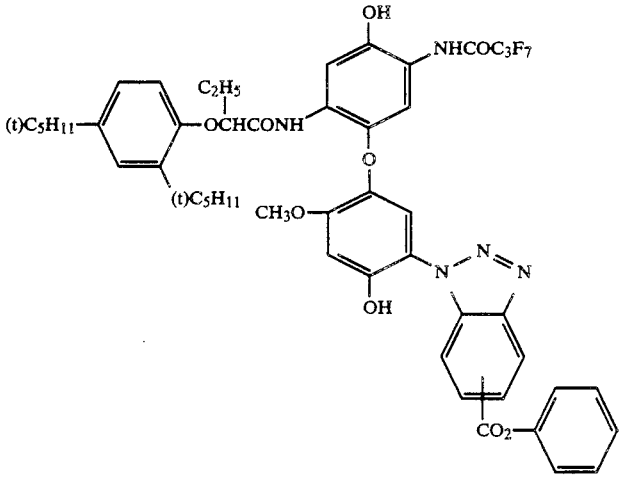
(5)
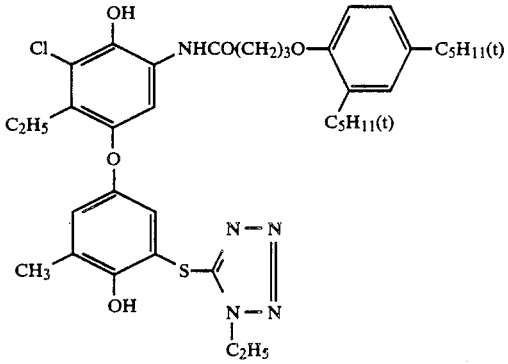
(6)
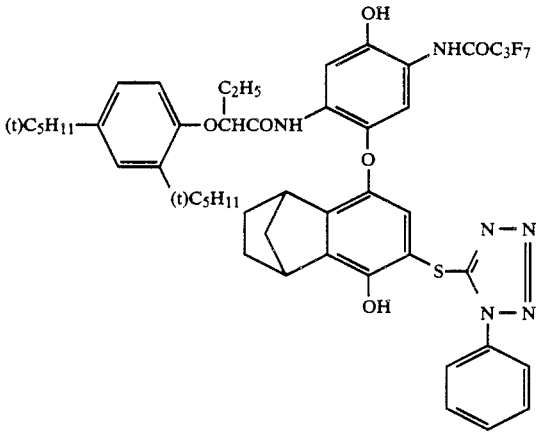

-continued
(7)
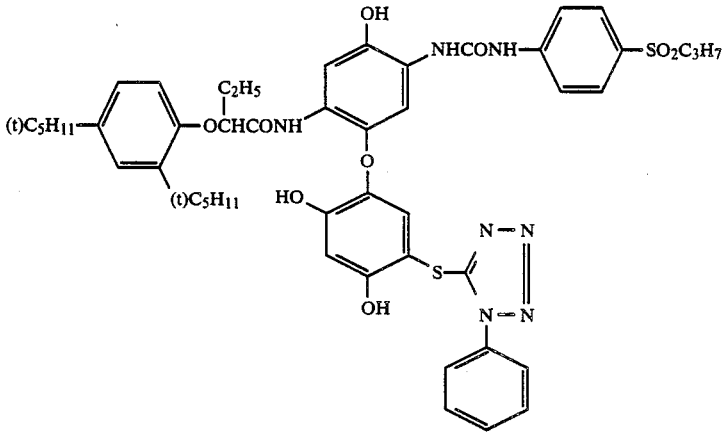
(8)
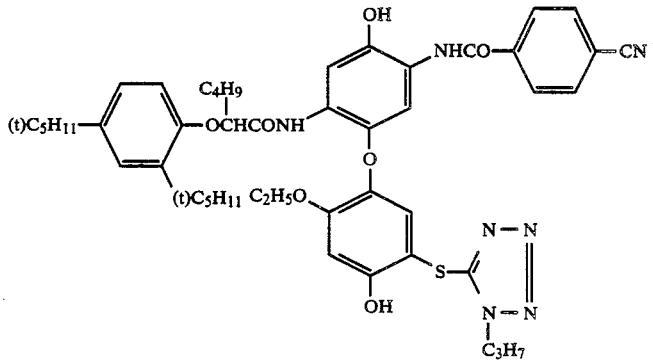
(9)
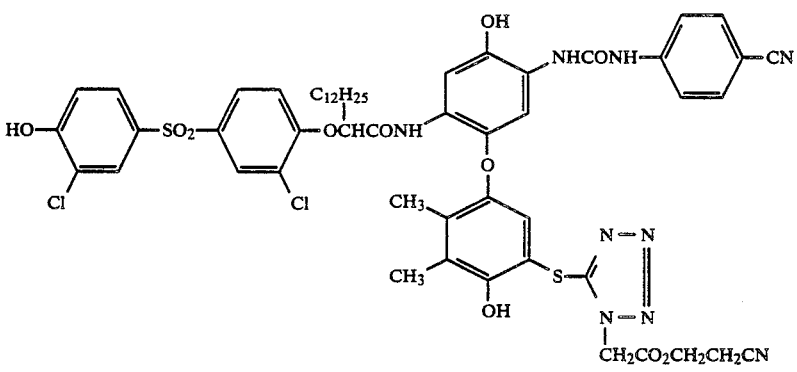
(10)
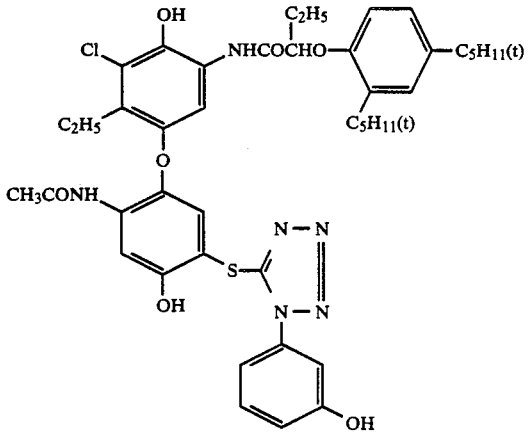

-continued
(11)
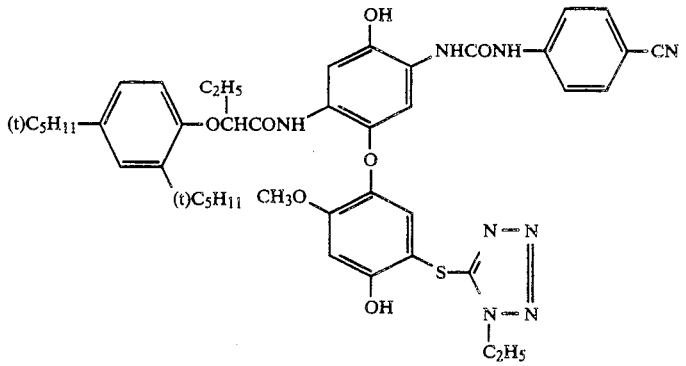
(12)
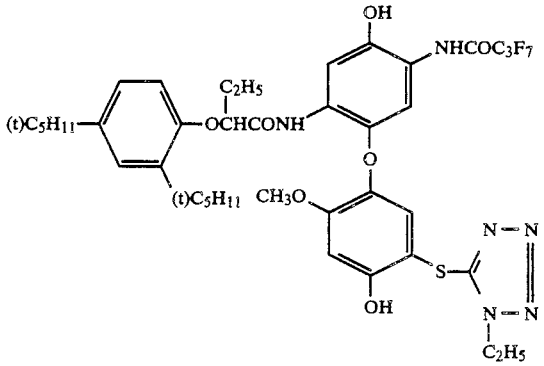
(13)
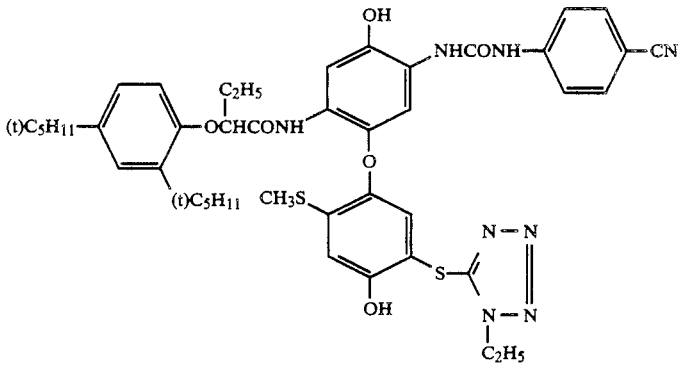
(14)
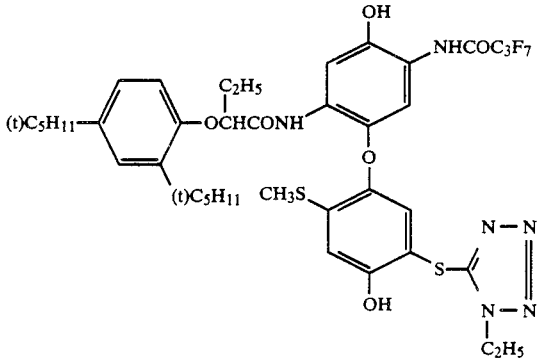

-continued
(15)
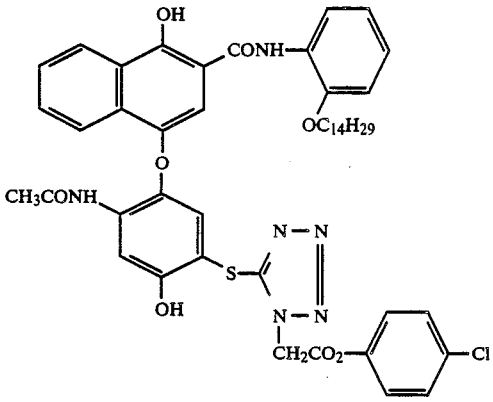
(16)
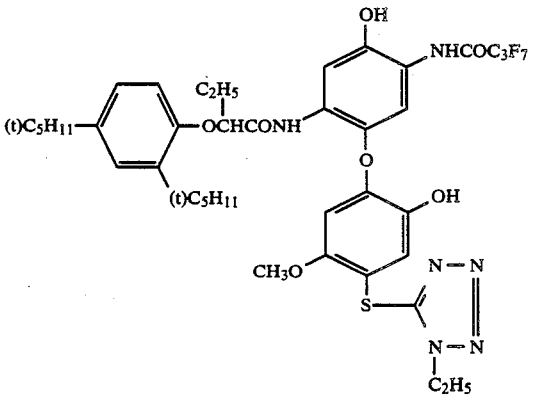
(17)
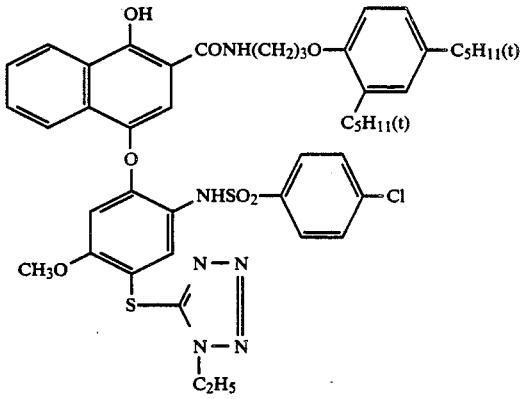
(18)
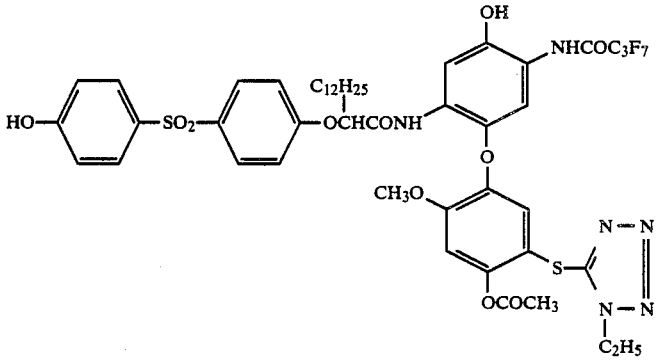

-continued
(19)
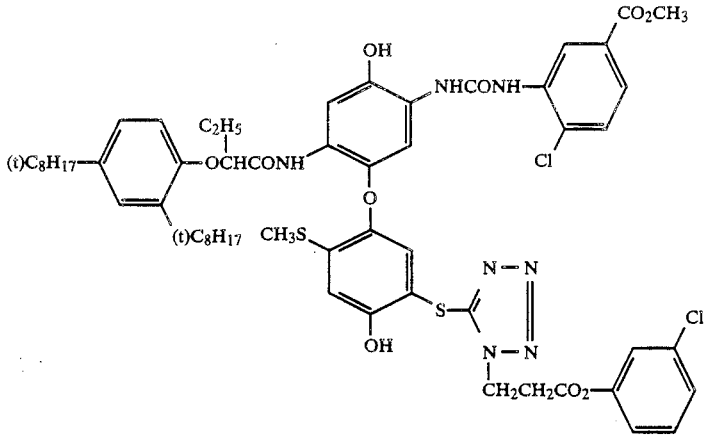
(20)
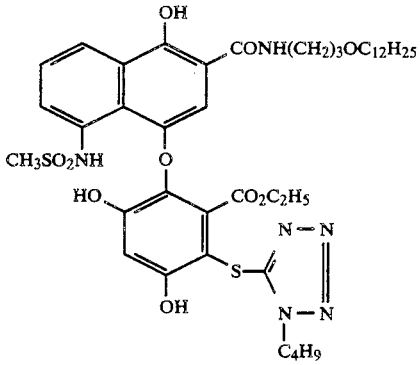
(21)
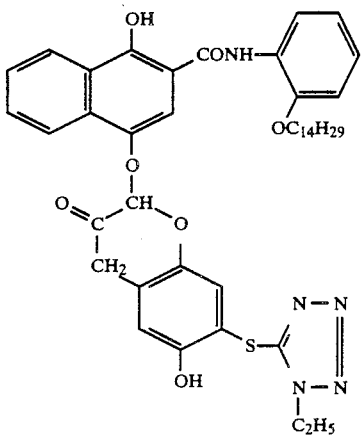

-continued
(22)
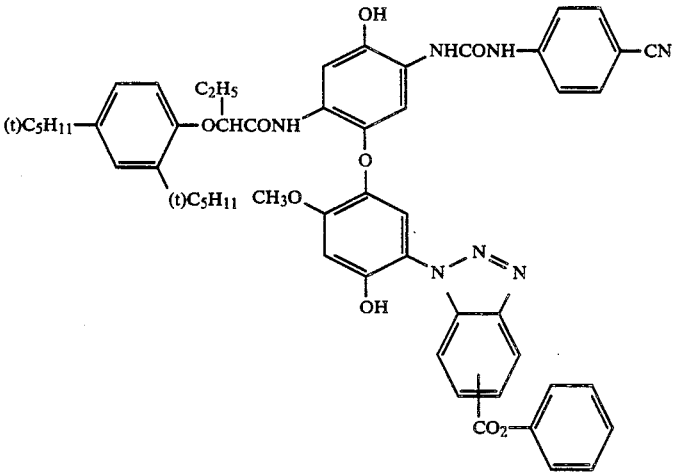
(23)
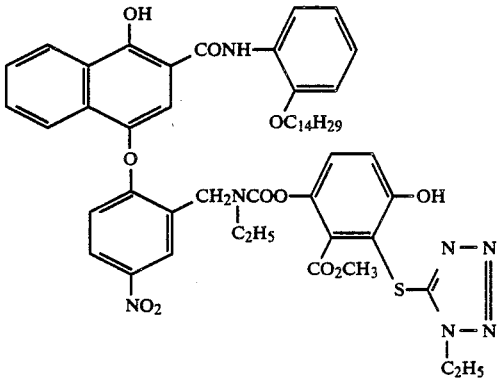
(24)
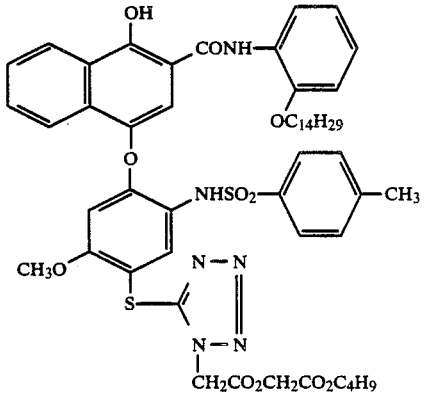

-continued
(25)
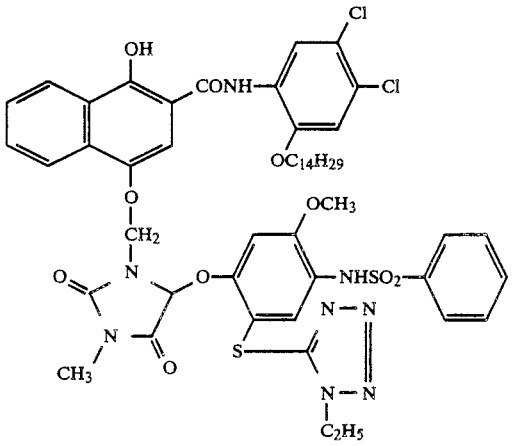
(26)
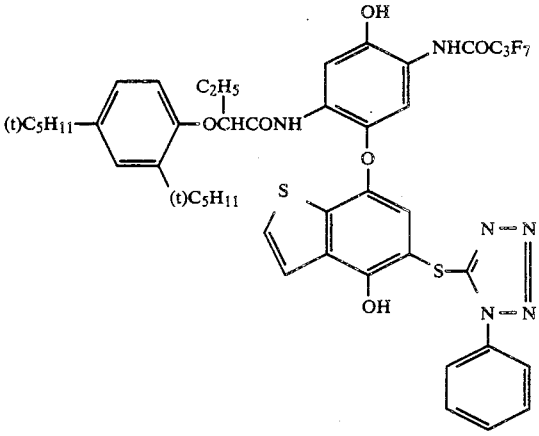
(27)
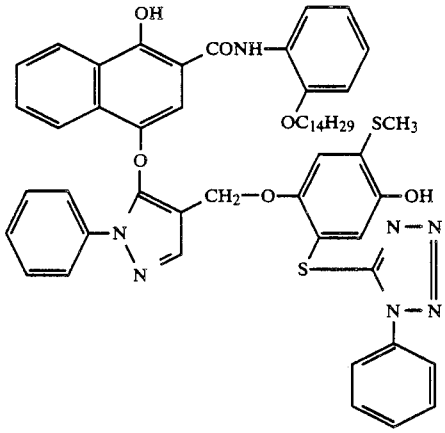
(28)
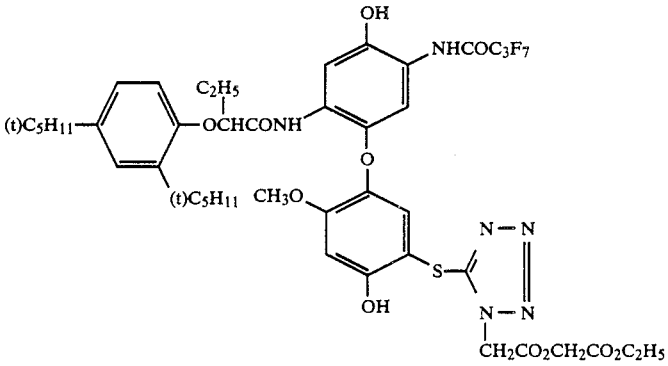

-continued
(29)
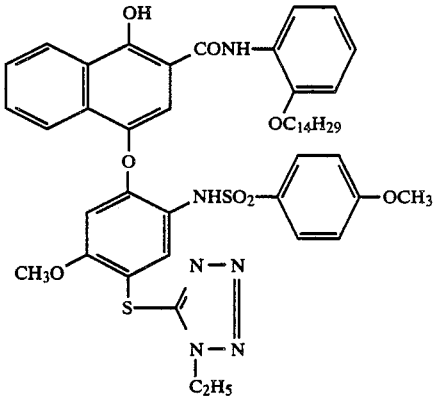
(30)
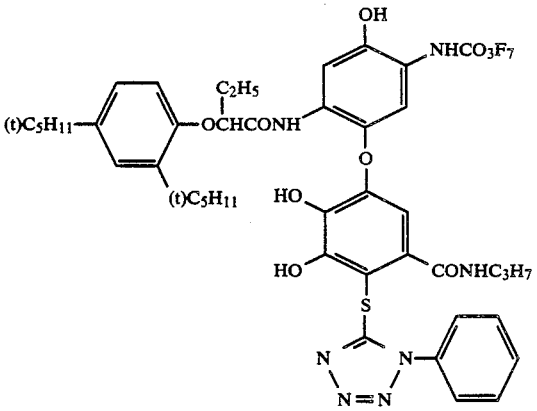
(31)
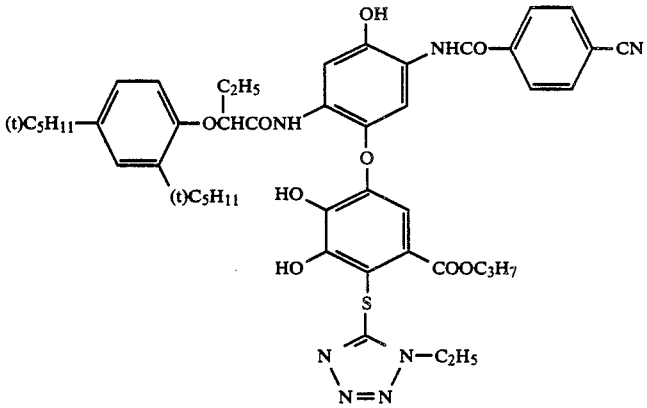

-continued
(32)
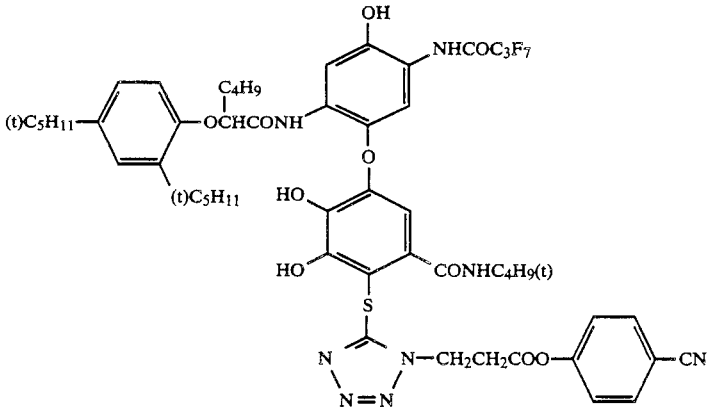
(33)
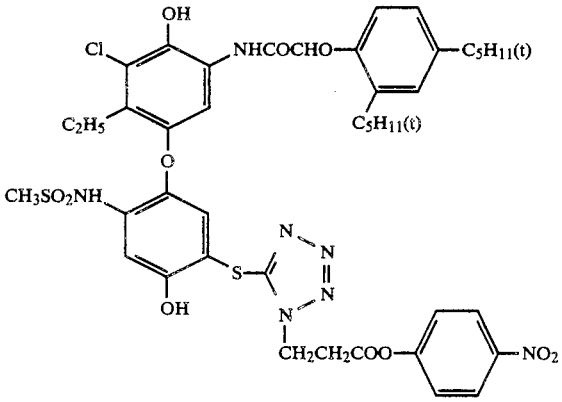
(34)
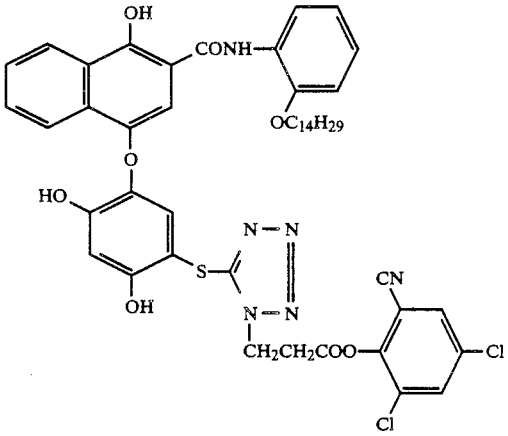
(35)
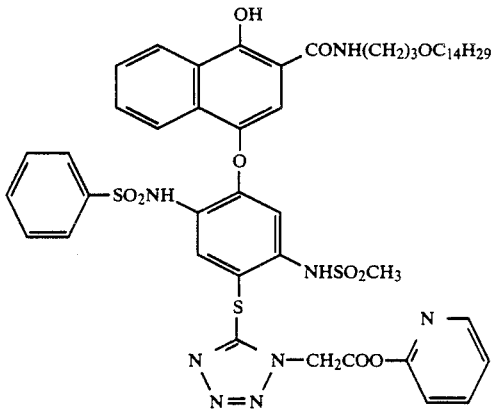

-continued
(36)
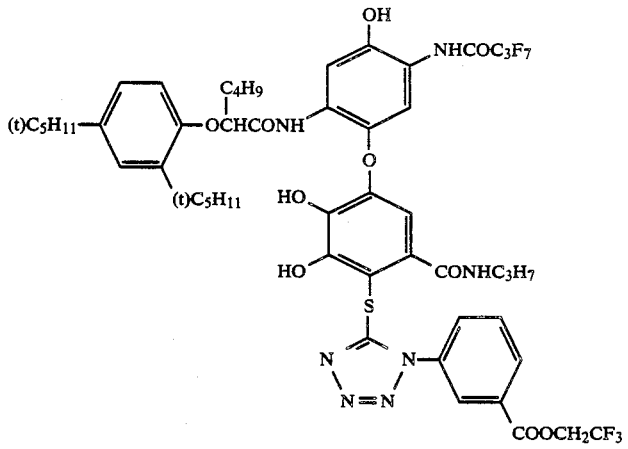
(37)
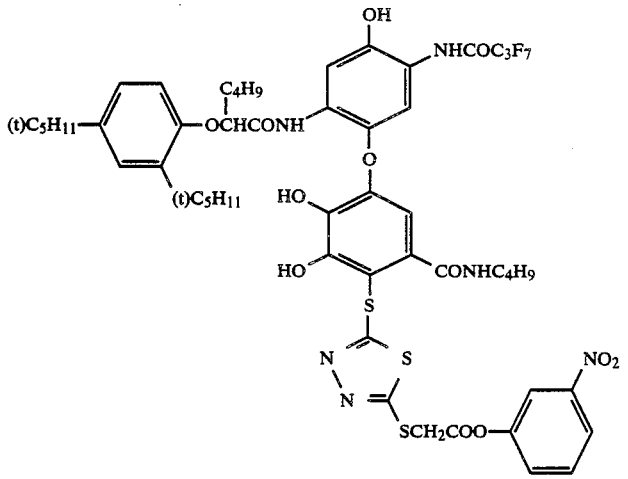
(38)
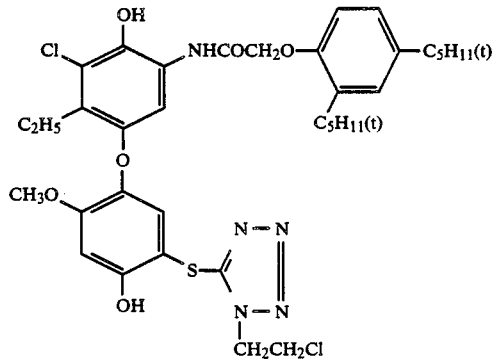

-continued
(51)
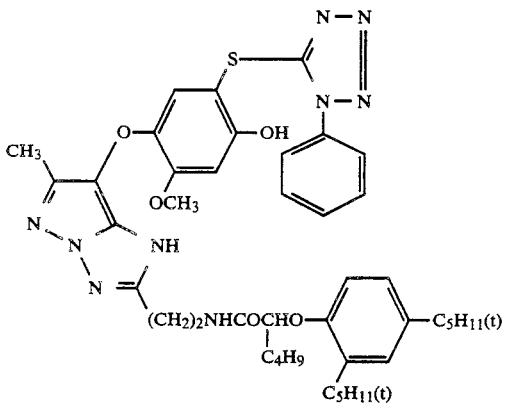
(52)
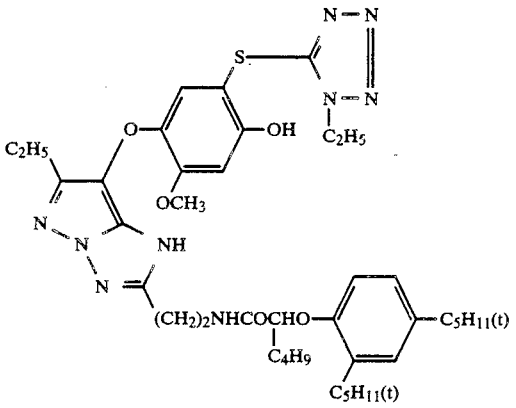
(53)
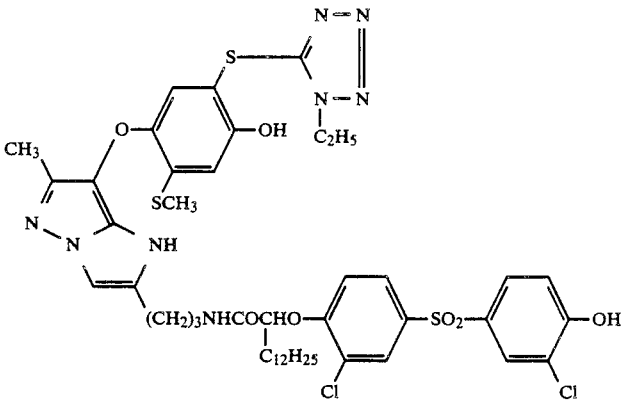
(54)
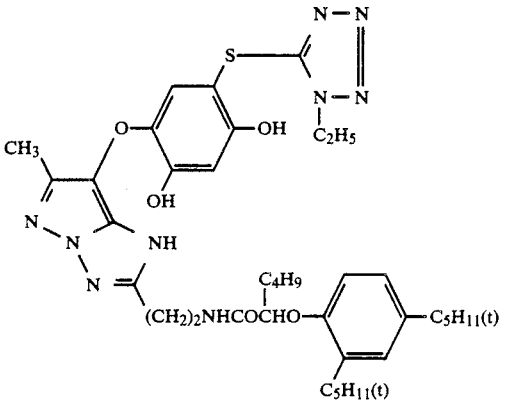

-continued
(55)
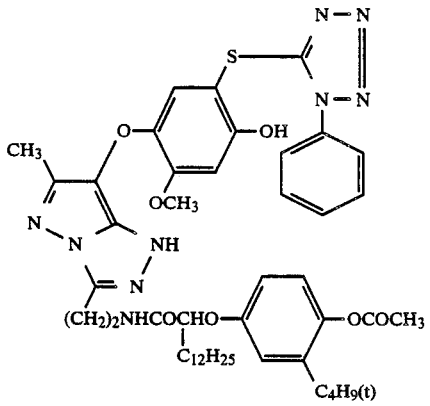
(56)
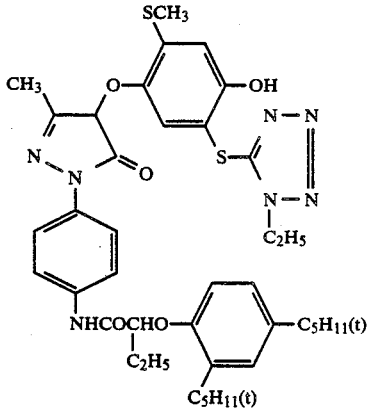
(57)
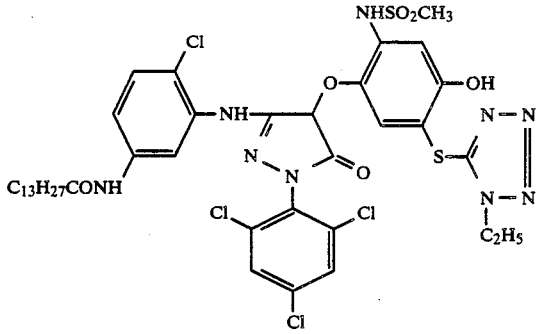
(58)
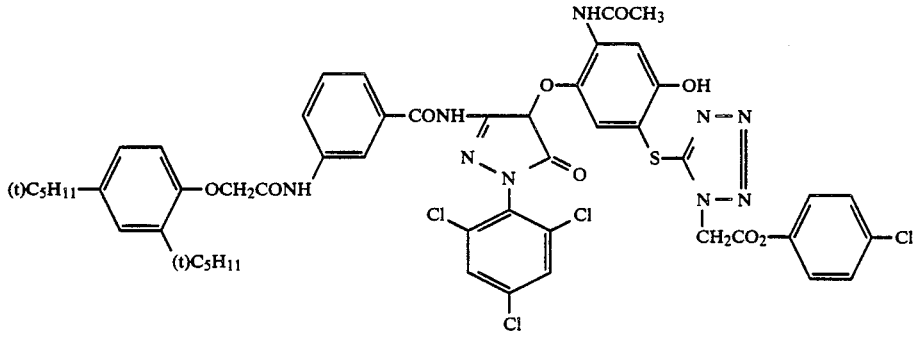

-continued
(59)
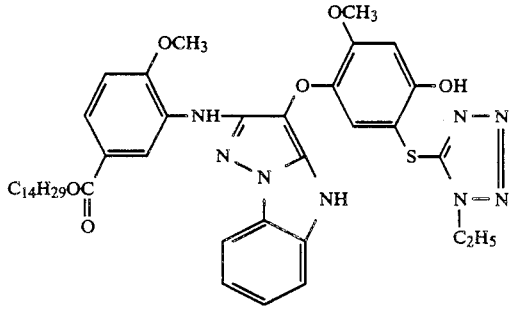
(60)
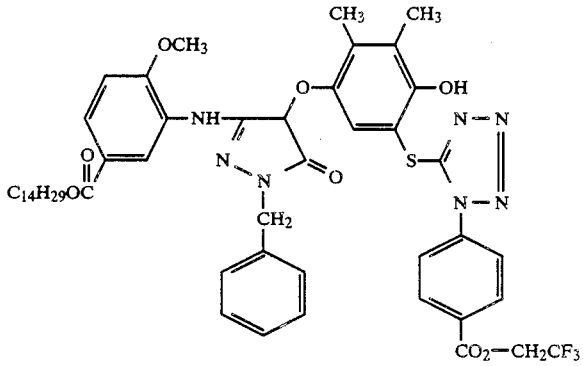
(61)
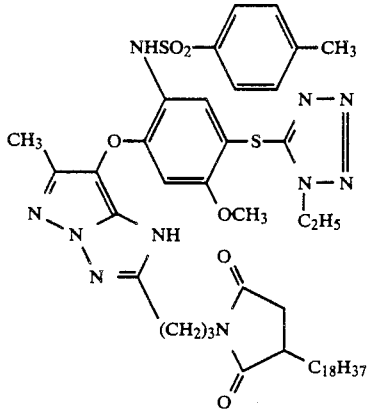
(62)
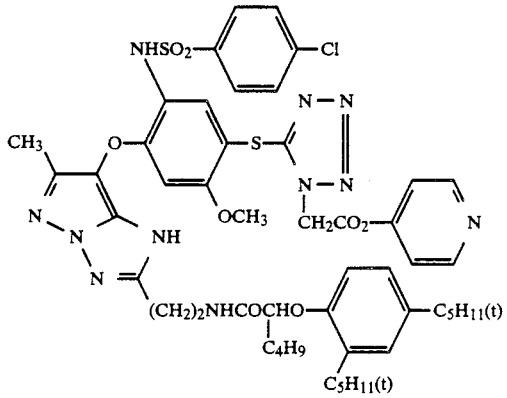

-continued
(63)
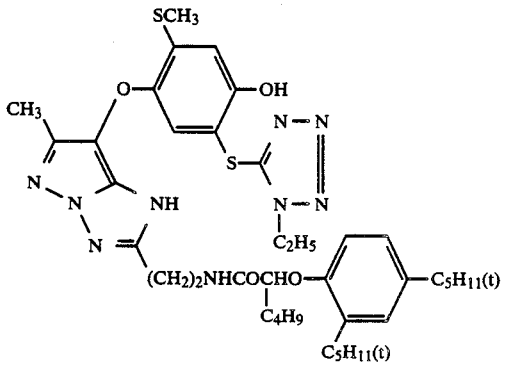
(64)
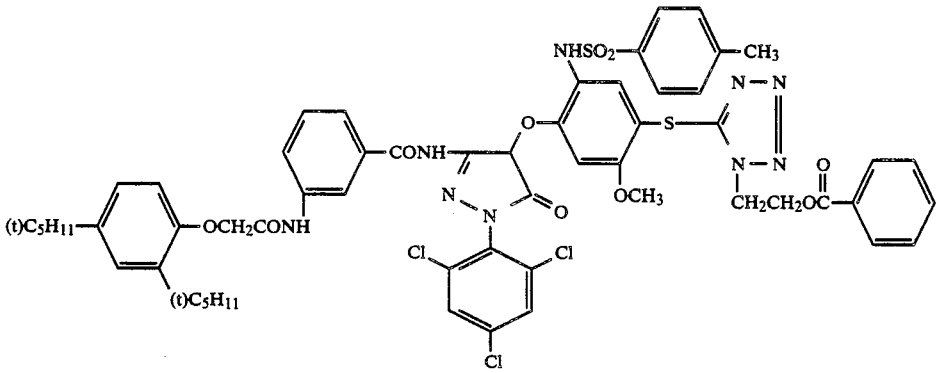
(65)
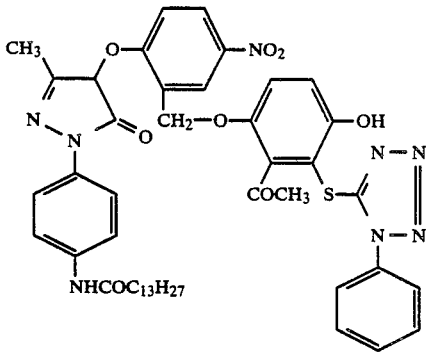
(66)
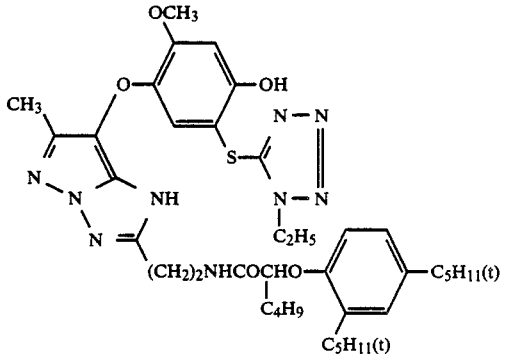

-continued
(67)
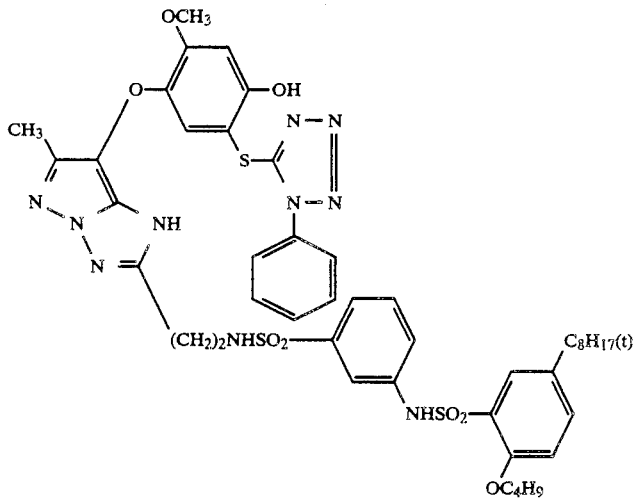
(68)
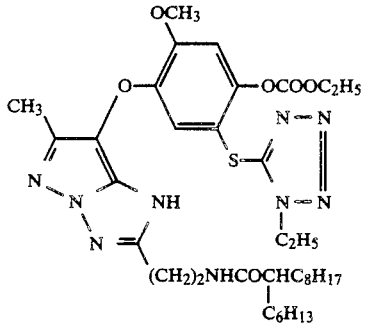
(69)
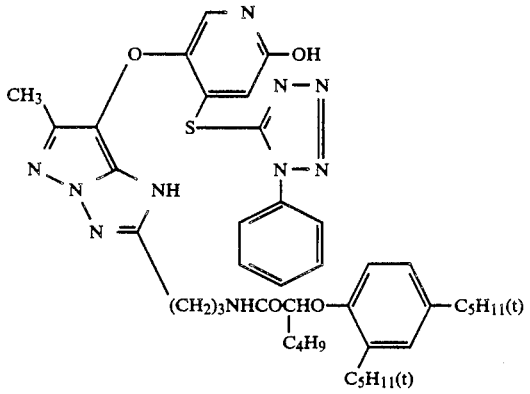
(70)
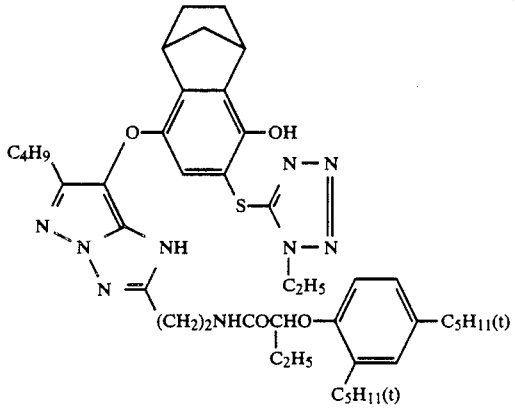

-continued
(71)
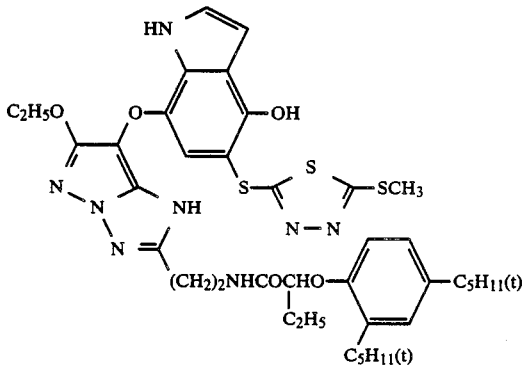
(72)
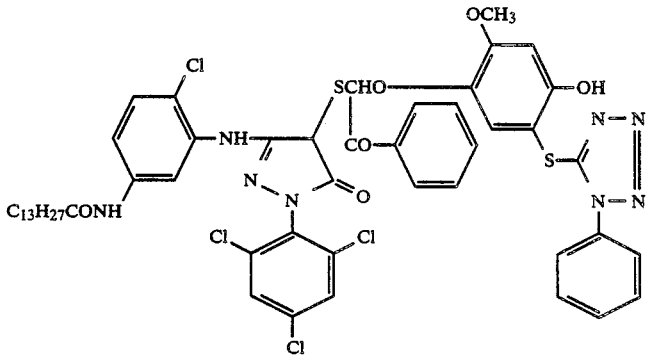
(73)
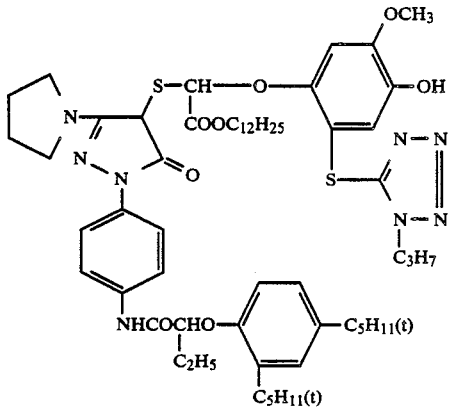
(74)
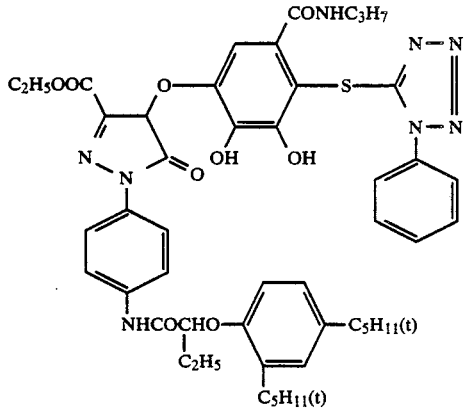

-continued
(75)
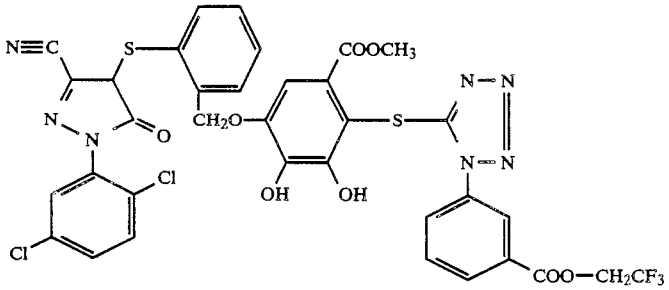
(76)
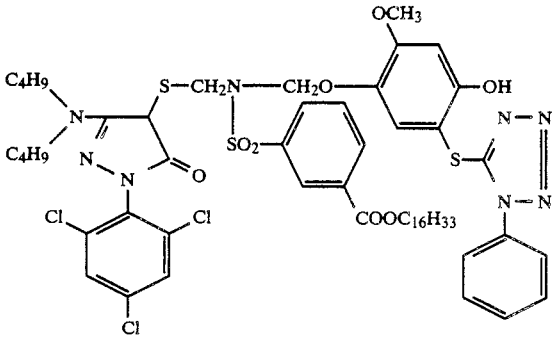
(77)
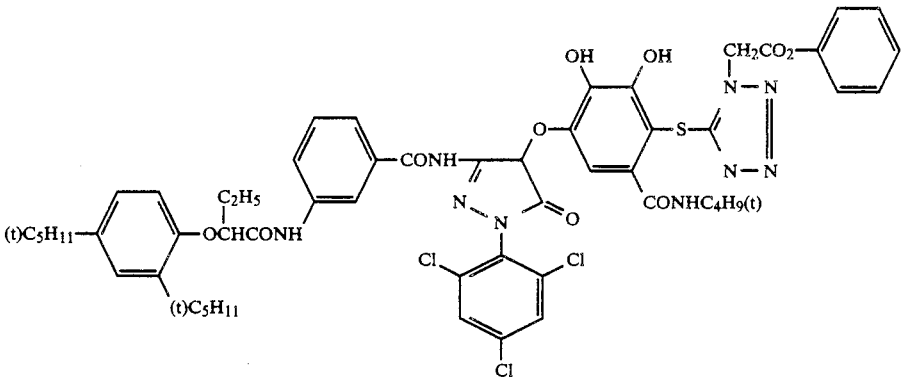
(78)
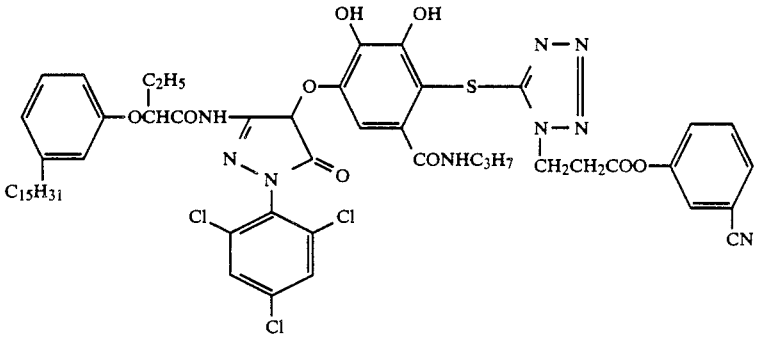

-continued
(101)
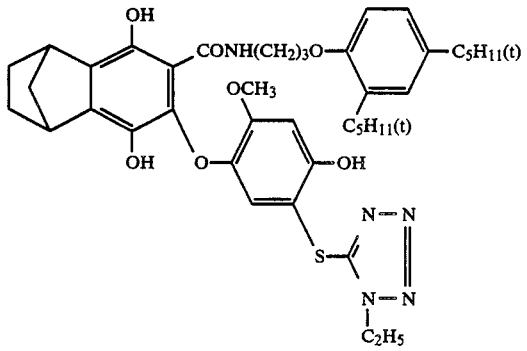
(102)
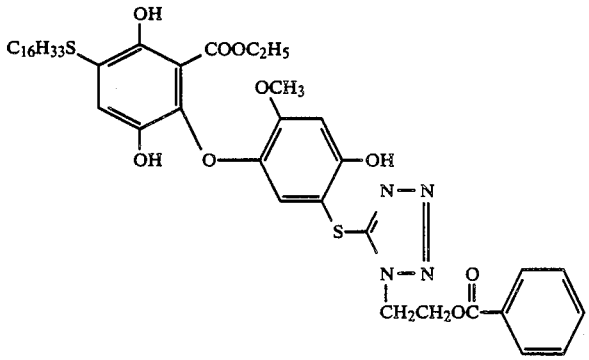
(103)
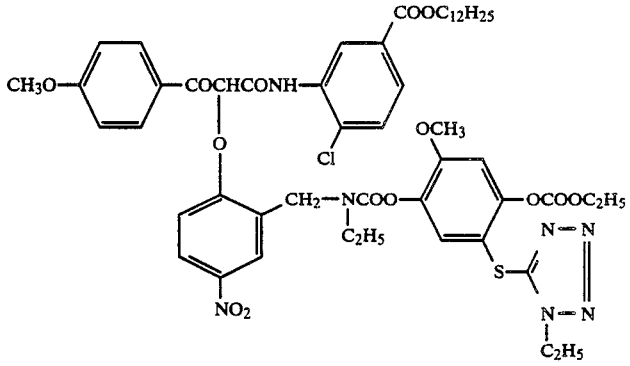
(104)
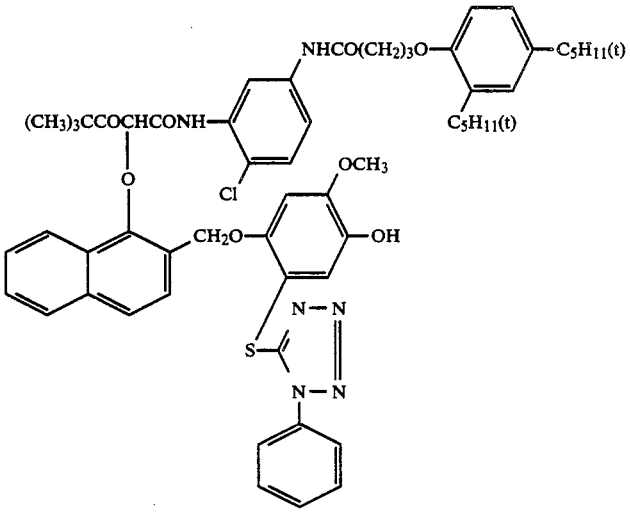

-continued
(105)
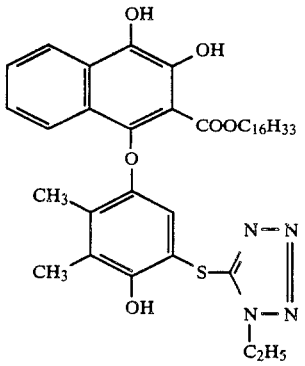
(106)
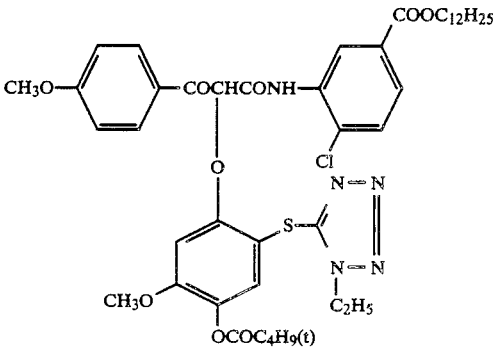
(107)
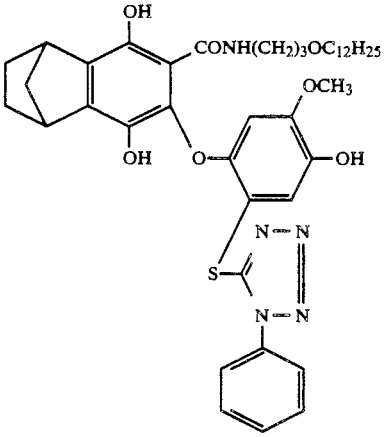
(108)
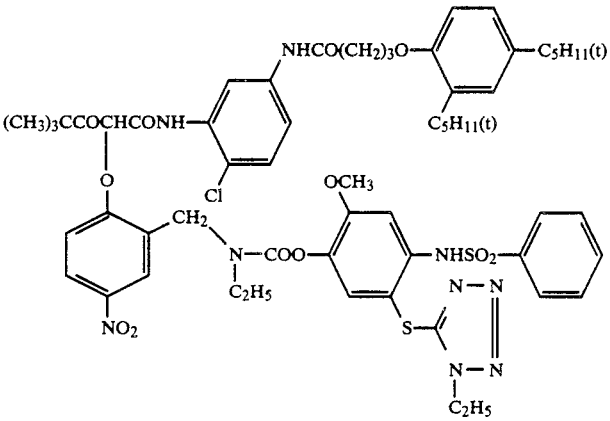

-continued
(109)
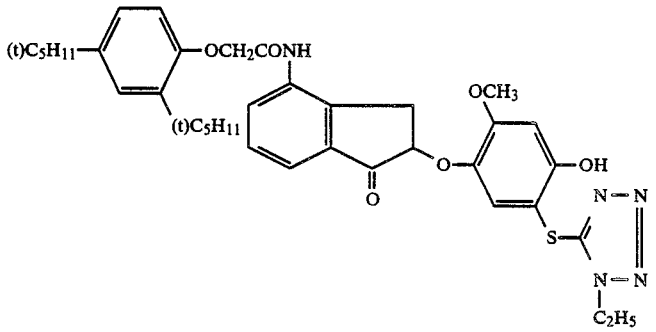
(110)
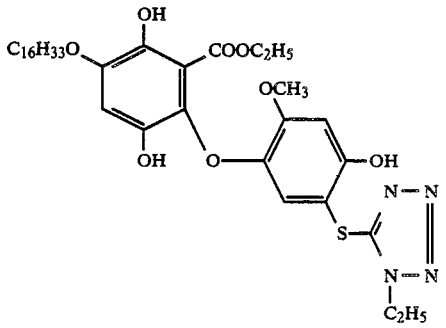
(111)
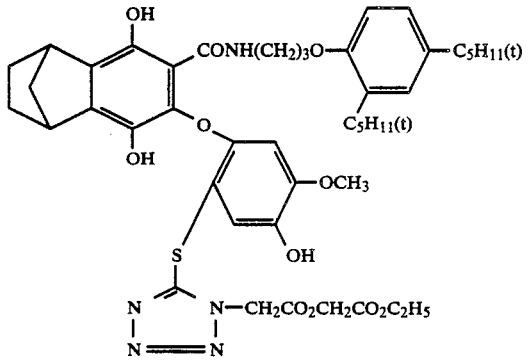
(112)
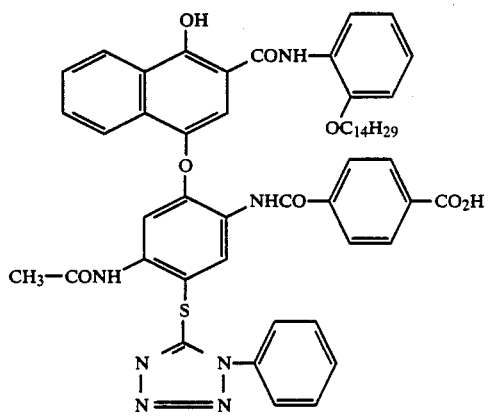

-continued
(113)
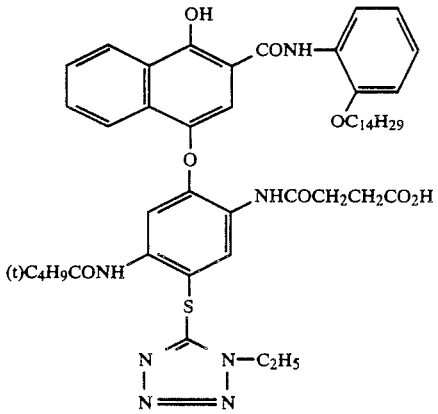
(114)
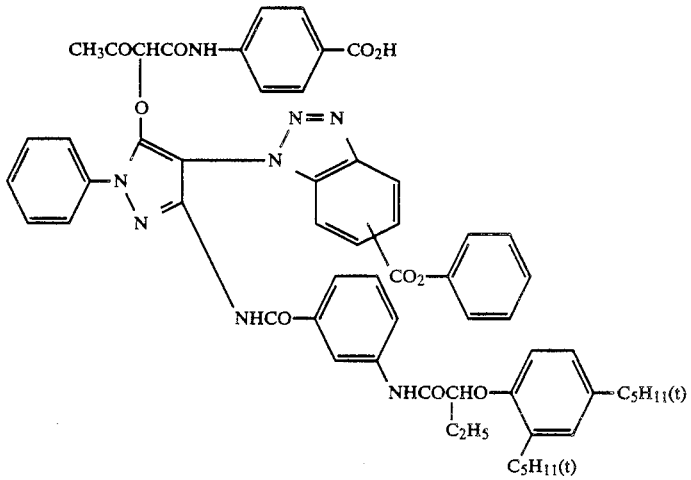
(115)
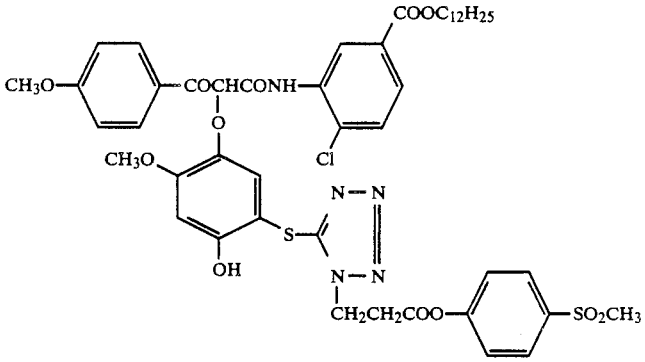
(116)
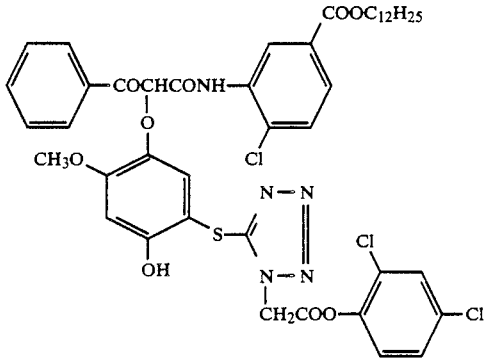

-continued
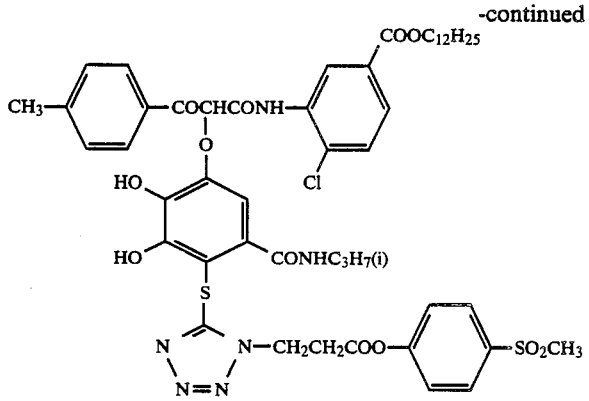
(117)
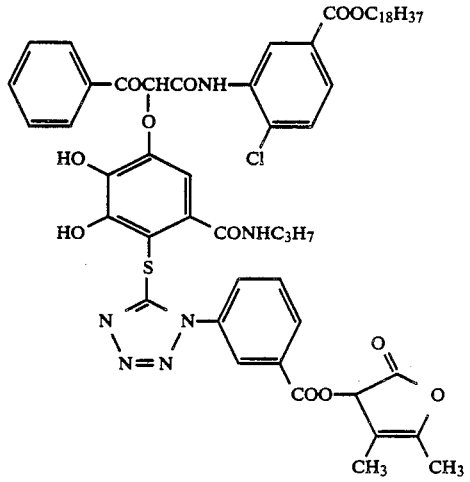
(118)
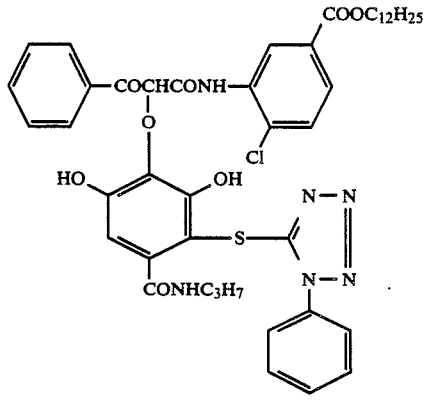
(119)
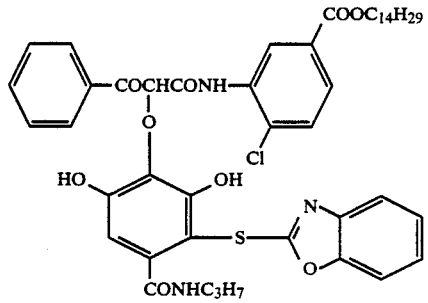
(120)
The compounds represented by the general formula (I) can be synthesized by the methods described in Japanese Patent application Nos. 33059/84, and 136973/84 (corresponding to European Patent No. 0157146A2 and Japanese Patent application (OPI) No. 15142/86, respectively), U.S. Pat. Nos. 4,248,962 and 4,477,560, British Patent (published) No. 2,072,363.

In the following, examples of the synthesis of the compound of the present invention are set forth. Other compounds can be prepared in synthesis similar to the following synthesis.
Synthesis (1): Synthesis of illustrative compound (1)
The illustrative compound (1) was prepared by the following synthesis:
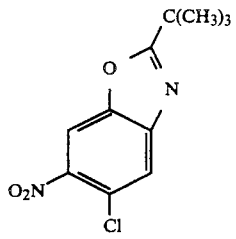
1
+
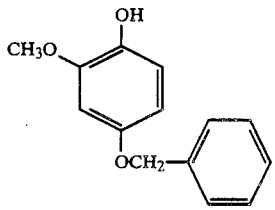
2
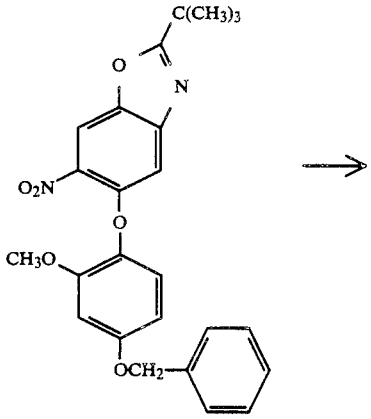
3
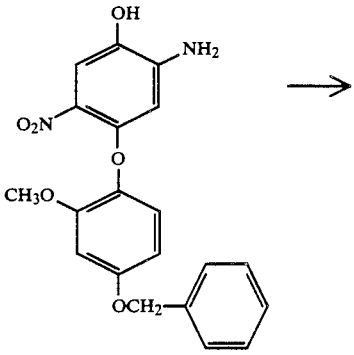
4
-continued
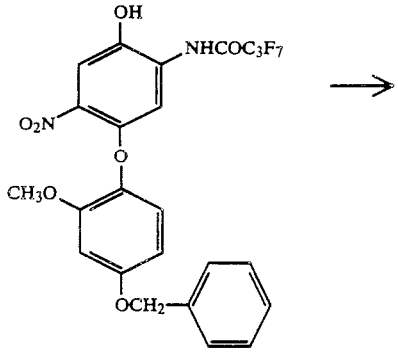
5
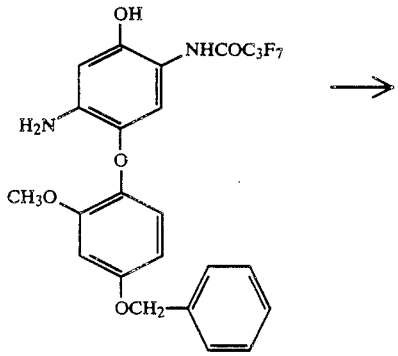
6
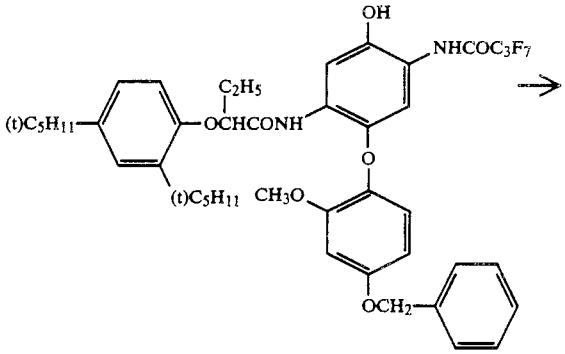
7
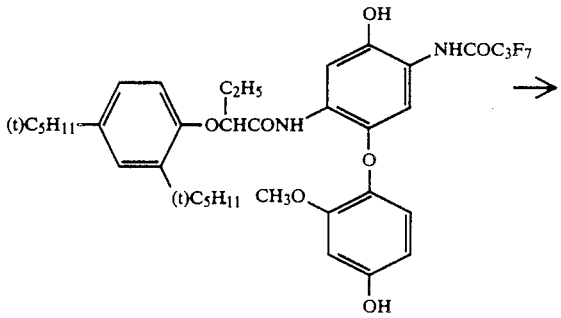
8

-continued

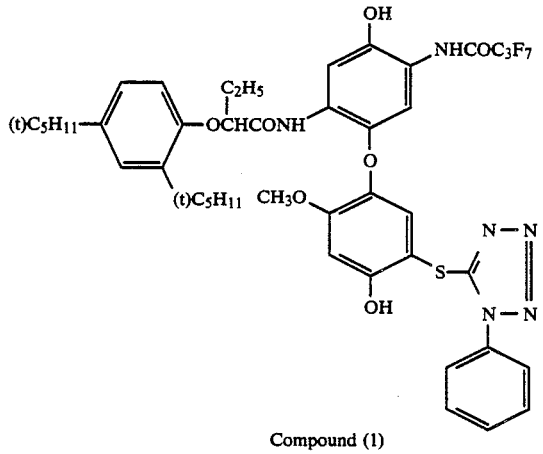

Compound (1)

Step 1: Synthesis of intermediate compound 3

62 g of the compound 2, 18 g of caustic soda and 10 ml of water were added to 700 ml of toluene. The admixture was heated under reflux in an atmosphere of nitrogen for 1 hour. From the reaction solution were distilled off water and toluene as euteric mixture. To the residue was added 200 ml of N,N-dimethylformamide and the admixture was heated at a temperature of 100° C. To the heated admixture was added 57 g of the compound 1. After the admixture underwent a reaction at a temperature of 100° C. for 1 hour, the reaction solution was allowed to cool down to room temperature and then ethyl acetate was added to the cooled solution. The solution was transferred to a separating funnel and it was washed with water. After the ethyl acetate phase was separated, the solvent was removed under reduced pressure to obtain 53 g or the oil residue containing, as a main component, the compound 3.

Step 2: Synthesis of intermediate compound 4

53 g of the compound 3 which had been prepared in Step 1 was dissolved in a mixed solvent of 400 ml of ethanol and 120 ml of water. 40 g of potassium hydroxide was added to the solution. After the solution was heated under reflex for 4 hours, the reaction solution was mixed with hydrochloric acid until neutralization was reached. The neutralized solution was then transferred to a separating funnel together with ethyl acetate and water. After the ethyl acetate phase was separated, the solvent was distilled off to obtain 43 g of the oil residue containing, as a main component, the compound 4.

Step 3: Synthesis of intermediate compound 5

43 g of the compound 4 which had been prepared in Step 2 was dissolved in 300 ml of ethyl acetate. 69 g of anhydrous heptafluoropropionic acid was dropwise added to the solution at room temperature. After the solution underwent a reaction for 30 minutes, to the reaction solution was added water. The solution was then transferred to a separating funnel and it was washed with water. After the oil phase was separated, the solvent was distilled off. The residue was column-chromatographed to isolate and purify the objective compound on silica gel with 2.5% ethanol-containing chloroform eluents. 47 g of oil compound 5 was obtained.

Step 4: Synthesis of intermediate compound 6

47 g of the compound 5 which had been prepared in Step 3, 363.3 g of iron filings and 10 ml of acetic acid were added to a mixed solvent of 40 ml of water and 400 ml of isopropanol. The admixture was heated under reflex for 1 hour. While the solution thus reflexed was hot, it was filtered. The filtrate was concentrated until the amount thereof became about half. The crystals thus precipitated were filtered off to obtain 44 g of the compound 6.

Step 5: Synthesis of intermediate compound 7

44 g of the compound 6 which had been prepared in Step 4 was added to 400 ml of acetonitrile at the admixture was heated under reflex. 28 g of 2-(2,4-di-t-amylphenoxy)-butanoyl chloride was added dropwise to the reflexed admixminutes, after the solution was heated under reflux for 30 minutes it was allowed to cool down to room temperature. Ethyl acetate was added to the reaction solution. The reaction solution was then transferred to a separating funnel and it was washed with water. After the oil phase was separated, the solvent was distilled off under reduced pressure. The residue was recrystallized from acetonitrile to obtain 60 g of the compound 7.

Step 6: Synthesis of intermediate compound 8

60 g of the compound 7 which had been prepared in Step 5 was added to 500 ml of dichloromethane. The admixture was cooled to a temperature of −10° C. 34.5 g of boron tribromide was dropwise added to the cooled admixture. After the admixture underwent a reaction at a temperature of −5° C. or less for 20 minutes, an aqueous solution of sodium carbonate was dropwise added thereto until neutralization was reached. The neutralized solution was transferred to a separating funnel and it was washed with water. After the oil phase was separated, the solvent was removed under reduced pressure. The residue was recrystallized from acetonitrile to obtain 45.2 g of the compound 8.

Step 7: Synthesis of the illustrative compound (1)

45.2 g of the compound 8 which had been prepared in Step 6 was added to 600 ml of acetonitrile. To the admixture was dropwise added 100 ml of chloroform solution containing 20.2 g of 1-phenyltetrazolyl-5-sulfenyl chloride at room temperature (25° C.). To the reaction solution was added ethyl acetate. The solution was transferred to a separating funnel and it was washed with water. After the oil phase was separated, the solvent was distilled off. The residue was recrystallized from a mixed solvent of hexane and ethyl acetate to obtain 45.3 g of the desired illustrative compound (1). The melting point thereof was 201 to 202° C.

Synthesis (2): Synthesis of illustrative compound (30)

The illustrative compound (30) was prepared by the following synthesis.

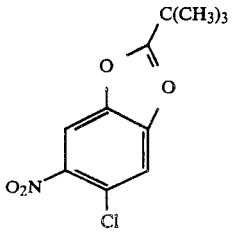
1
+
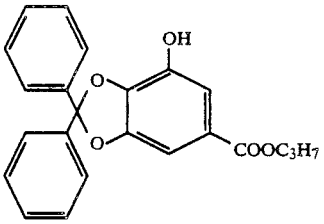
9
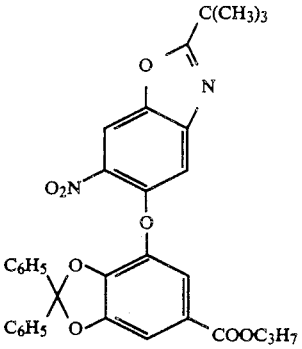
10
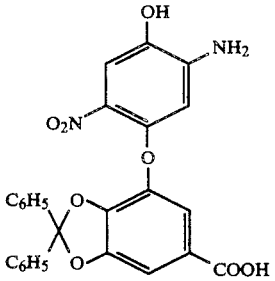
11
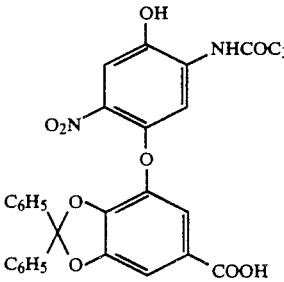
12
-continued
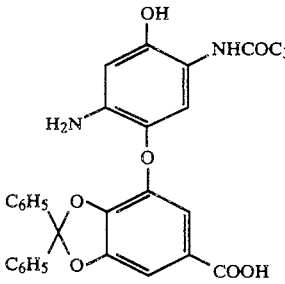
13
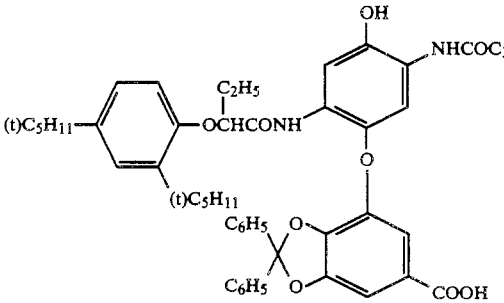
14
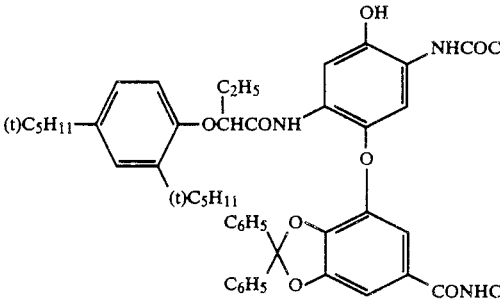
15
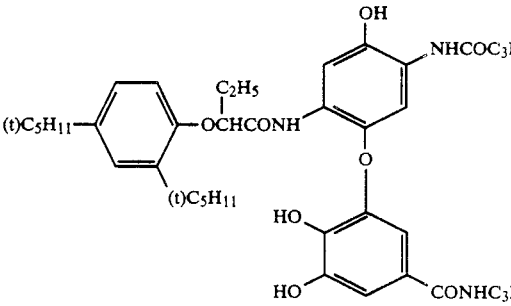
16

-continued

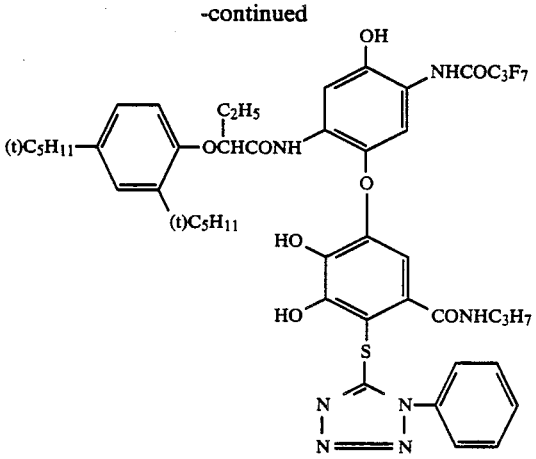

Compound (30)

Step 1: Synthesis of intermediate compound 10

147.7 g of the compound 9 (which had been prepared in the same manner as described in J. Am. Chem. Soc., 81, 4606 (1959)), 24.6 g of potassium hydroxide and 15 ml of water was added to 1 l of toluene. The admixture was heated under reflex for 1 hour. From the reaction solution were distilled off water and toluene as euteric mixture. To the residue were added 500 ml of N,N-dimethylformamide, 70 g of the compound 1, 0.5 g of cuprous chloride and the solution underwent a reaction at a temperature of 120° C. for 4 hours. After the reaction solution was allowed to cool down to room temperature, 12 ml of hydrochloric acid, 150 ml of water and 500 ml of methanol were added thereto. The crystals thus precipitated were filtered off to obtain 120 g of the compound 10.

Step 2: Synthesis of intermediate compound 11

55.9 g of the compound 10 which had been prepared in Step 1 was added to a mixed solvent of 300 ml of ethanol and 100 ml of water. The admixture was then purged by bubbling with nitrogen gas. 31.4 g of potassium hydroxide was added to the solution and then heated under reflux for 6 hours. The solution thus refluxed was allowed to cool down to room temperature and mixed with hydrochloric acid until neutralization was reached. 500 ml of ethyl acetate was added to the solution thus neutralized, and the solution was transferred to a separating funnel. The solution was washed with water. After the oil phase was separated, the solvent was removed under reduced pressure. All the residue (46.2 g) was used in the subsequent step.

Step 3: Synthesis of intermediate compound 12

46.2 g of the compound 11 which had been prepared in Step 2 was dissolved in 500 ml of ethyl acetate. 47.3 g of anhydrous heptafluorobutanoic acid was added dropwise to the solution at room temperature. After the solution underwent a reaction at room temperature for 40 minutes, the reaction solution was mixed with an aqueous solution of sodium carbonate until neutralization was reached. The reaction solution was then transferred to a separating funnel where the oil phase was separated and washed with water. After the oil phase was separated, the solvent was removed under reduced pressure. Chloroform was added to the residue so that crystals precipitated. The crystals thus precipitated were filtered off, and the filtrate was then concentrated to obtain 52.5 g of the compound 12 which was all used in the subsequent step.

Step 4: Synthesis of intermediate compound 13

52.5 g of the compound 12 which had been prepared in step 3, 53 g of reduced iron, 3 g of ammonium chloride, and 3 ml of acetic acid were added to a mixed solvent of 280 ml of isopropanol and 40 ml of water. The admixture was heated under reflux for 1 hour. While the solution thus refluxed was hot, it was filtered. The filtrate was concentrated under reduced pressure until crystals precipitated. The filtrate thus concentrated was cooled. The crystals were filtered off to obtain 45.2 g of the compound 13.

Step 5: Synthesis of intermediate compound 14

45.2 g of the compound 13 was added to 500 ml of acetonitrile. 28.3 g of 2-(2,4-di-t-amylphenoxy)butanoyl chloride was added dropwise to the admixture while it was heated under reflux. After the mixture underwent a reaction under reflux for 30 minutes, it was allowed to cool down to room temperature. 500 ml of ethyl acetate was added to the reaction solution. The reaction solution was then washed with water. After the oil phase was separated, the solvent was removed under reduced pressure. The residue was recrystallized from ethyl acetate and n-hexane to obtain 56.7 g of the compound 4.

Step 6: Synthesis of intermediate compound 15

56.7 g of the compound 14 which had been prepared in Step 5 was added to a mixed solvent of 250 ml of tetrahydrofuran, 250 ml of acetonitrile and 10 ml of N,N-dimethylformamide. To the admixture was dropwise added 42.4 g of thionyl chloride at room temperature. After the solution underwent a reaction for 30 minutes, it was cooled down to −10° C.

To the solution thus cooled was dropwise added 67.7 g of propylamine while keeping the temperature of the solution at 0° C. or less. After the solution was underwent a reaction at a temperature of 0° C. or less for 30 minutes, ethyl acetate was added thereto. The admixture was washed with water. After the oil phase was separated, the solvent was removed under reduced pressure. The residue was recrystallized from a mixed solvent of ethyl acetate and hexane to obtain 45.2 g of the compound 15.

Step 7: Synthesis of intermediate compound 16

45.2 g of the compound 15, which had been prepared in Step 6 was added to a mixed solvent of 300 ml of ethanol and 15 ml of hydrochloric acid. The admixture was heated under reflux for 1 hour. After the reaction solution was allowed to cool down to room temperature, 200 ml of water was added thereto. The crystals thus precipitated were filtered off to obtain 28.6 g of the compound 16.

Step 8: Synthesis of the illustrative compound (30)

28.6 g of the compound 16 which had been prepared in Step 7 was added to 600 ml of tetrahydrofuran. After the admixture was cooled down to −10° C., 4.6 g of aluminum chloride was added thereto. To the solution was dropwise added 60 ml of dichloromethane solution containing 8.8 g of 1-phenyltetrazolyl-5-sulfenyl chloride. After the solution underwent a reaction at a temperature of −10° C. for 30 minutes, ethyl acetate and water was added thereto. The reaction solution was transferred to a separating funnel where the oil phase was separated and washed with water. After the oil phase was separated, the solvent was removed under reduced pressure. The residue was recrystallized from a mixed solvent of hexane and ethanol to obtain 24.9 g of the desired illustrative compound (30). The melting point thereof was 197° to 202° C.

Synthesis (3): Synthesis of illustrative compound (6)

The illustrative compound (6) was prepared by the following synthesis:

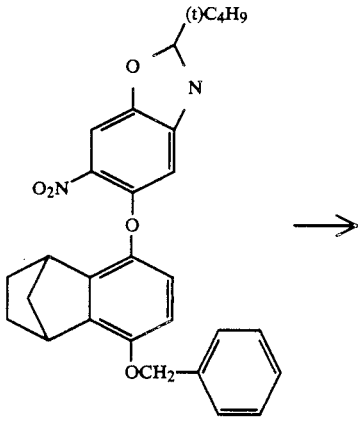

17

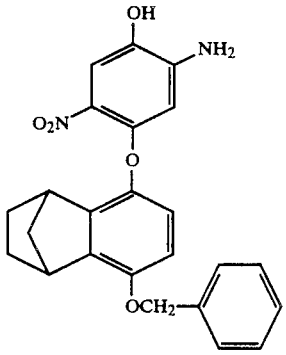

18

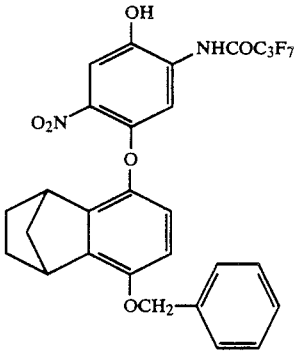

19

-continued

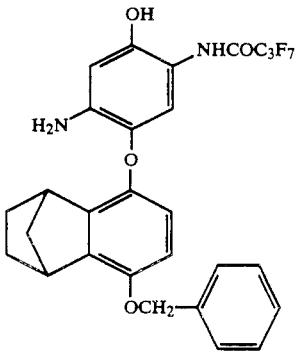

20

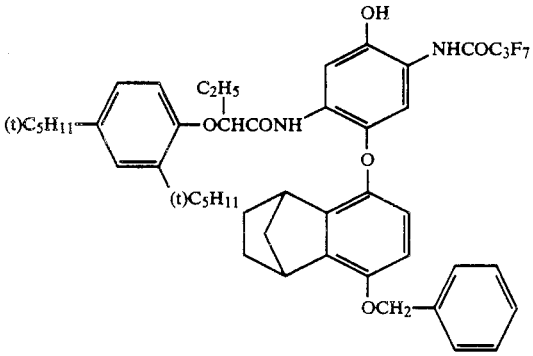

21

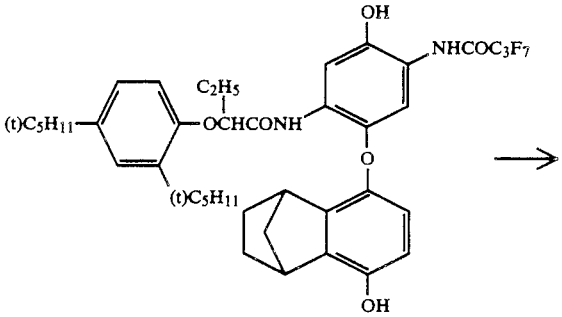

22

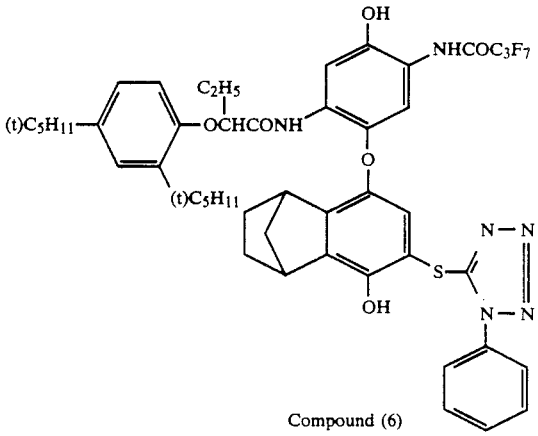

Compound (6)

Step 1: Synthesis of intermediate compound 18

34.8 g of the compound 17 was added to a mixed solvent of 300 ml of ethanol and 100 ml of water. The admixture was then purged by bubbling with nitrogen gas. 23.7 g of potassium hydroxide was added to the solution and then heated under reflux for 6 hours. The solution thus refluxed was allowed to cool down to room temperature and mixed with hydrochloric acid until neutralization was reached. 500 ml of ethyl acetate was added to the solution thus neutralized, and the resulting product was transferred to a separating funnel. The product was washed with water. After the oil phase was separated, the solvent was removed under reduced pressure. All the residue (30.1 g) was used in the subsequent step.

Step 2: Synthesis of intermediate compound 19

30.1 g of the compound 18 which had been prepared in Step 1 was dissolved in 250 ml of ethyl acetate. 35.4 g of anhydrous heptafluorobutanoic acid was added dropwise to the solution at room temperature. After the solution underwent a reaction at room temperature for 40 minutes, the reaction solution was mixed with an aqueous solution of sodium carbonate until neutralization was reached. The reaction solution was then transferred to a separating funnel where the oil phase was separated and washed with water. After the oil phase was separated, the solvent was removed under reduced pressure. Chloroform was added to the residue so that crystals precipitated. The crystals thus precipitated were filtered off, and the filtrate was then concentrated to obtain 44.1 g of the compound 19 which was all used in the subsequent step.

Step 3: Synthesis of intermediate compound 20

44.1 g of the compound 19 which had been prepared in Step 2, 32 g of reduced iron, 3 g of ammonium chloride, and 3 ml of acetic acid were added to a mixed solvent of 150 ml of isopropanol and 50 ml of water. The admixture was heated under reflux for 3 hours. While the solution thus refluxed was hot, it was filtered. The filtrate was concentrated under reduced pressure until crystals precipitated. The filtrate thus concentrated was cooled. The crystals were filtered off to obtain 38 g of the compound 20.

Step 4: Synthesis of intermediate compound 21

38 g of the compound 20 was added to 300 ml of acetonitrile. 23.1 g of 2-(2,4-di-t-amylphenoxy)butanoyl chloride was added dropwise to the mixture while it was heated under reflux. After the mixture underwent a reaction under reflux for 3 hours, it was allowed to cool down to room temperature. 500 ml of ethyl acetate was added to the reaction solution. The reaction solution was then washed with water. After the oil phase was separated, the solvent was removed under reduced pressure. The residue was recrystallized from ethyl acetate and acetonitrile to obtain 43.8 g of the compound 21.

Step 5: Synthesis of intermediate compound 22

43.8 g of the compound 21 which had been prepared in the previous step was added to 300 ml of dichloromethane. The admixture was cooled to a temperature of 0° C. 24.7 g of boron tribromide was added dropwise to the admixture thus cooled. After the admixture underwent a reaction at a temperature of 0° C. for 2 hours, the reaction solution was gradually heated to a temperature of 5° C. After the reaction solution underwent a reaction at a temperature of 5° C. for 1 hour, a saturated aqueous solution of sodium hydrogencarbonate was added dropwise thereto until neutralization was reached. The solution thus neutralized was transferred to a separating funnel where the oil phase was separated and washed with water. The resulting solution was washed with dilute hydrochloric acid and then with water until neutralization was reached. After the oil phase was separated, the residue was concentrated to obtain 36 g of the compound 22.

Step 6: Synthesis of the illustrative compound (6)

8.3 g of 5-mercaptophenyltetrazole and 6.4 g of sulfuryl chloride was reacted with each other indichloromethane at a temperature of 5° C. for 1 hour. The product was concentrated under reduced pressure. 10 ml of dichloromethane was added to the residue. The admixture was added dropwise at room temperature to a solution which had been prepared by dissolving 36 g of the compound 22 obtained in the previous step in 200 ml of acetonitrile, After the admixture underwent a reaction at room temperature for 2 hours, it was heated to a temperature of 60° C. and underwent a reaction for 1 hour. After the reaction solution was cooled to room temperature, 500 ml of ethyl acetate was added thereto. The solution was transferred to a separating funnel where it was washed with water until neutralization was reached. After the oil phase was separated, the solvent was removed under reduced pressure. The residue was recrystallized from a mixed solvent of ethyl acetate and hexane to obtain 28.5 g of the desired illustrative compound (6).

In the multilayer color photographic materials of the present invention, typically the red-sensitive emulsion layer contains a cyan forming coupler; the green-sensitive emulsion layer contains a magenta forming coupler; and the blue-sensitive emulsion layer contains a yellow forming coupler; however, depending on the intended purposes, different combinations may also be employed.

In the photographic light-sensitive materials containing the above-described compound of formula (I) in a photographic emulsion layer or a light-insensitive layer, the same or different photographic emulsion layer or light-insensitive layer can further contain color couplers, i.e., compounds capable of developing a color upon oxidative coupling with an aromatic primary amine developing agent, such as phenylenediamine derivatives, aminophenol derivatives, etc., in color development processing.

The silver halide multilayer color photographic light-sensitive materials prepared according to the present invention generally contain yellow, magenta, and cyan color forming couplers, and the couplers according to the present invention can be applied to all of these three colors. If desired, a part of the couplers of the invention may be replaced with conventionally known color couplers.

Useful color couplers are cyan, magenta, and yellow forming couplers typically exemplified by naphthol or phenol compounds, pyrazolone or pyrazoloazole compounds, and openchain or heterocyclic ketomethylene compounds, respectively. Specific examples of these cyan, magenta, and yellow couplers which can be used in this invention are described in patents cited in *Research Disclosure,* RD No. 17643, VII-D (Dec. 1978) and *ibid,* RD No. 18717 (Nov. 1979).

It is preferable that the color couplers to be incorporated into the light-sensitive materials have a ballast group or be in a polymerized form, and are thereby non-diffusible. Two-equivalent color couplers wherein the coupling active position is substituted with a releasable group are preferable to 4-equivalent color couplers wherein the coupling active position is a hydrogen atom, since the requisite silver coverage can be reduced and higher sensitivity can be obtained. Couplers which form colors having moderate diffusibility, colorless couplers, DIR couplers capable of releasing a development inhibitor upon coupling reaction or couplers capable of releasing a development accelerator upon coupling reaction can also be used.

Yellow couplers which can be used in the present invention typically include oil-protected acylacetamide couplers. Specific examples thereof are described in U.S. Pat. Nos. 2,407,210, 2,875,057 and 3,265,506, etc. Typical examples of 2-equivalent yellow couplers are those releasable via an oxygen atom as described in U.S. Pat. Nos. 3,408,194, 3,447,928, 3,933,501 and 4,022,620; and those releasable via a nitrogen atom as described in Japanese Patent Publication No. 10739/83, U.S. Pat. Nos. 4,401,752 and 4,326,024, *Research Disclosure,* RD No. 18053 (April 1979), British Patent No. 1,425,020, West German Patent Publication (OLS) Nos. 2,219,917, 2,261,361, 2,329,587 and 2,433,812, etc. α-Pivaloylacetanilide couplers are excellent in color fastness, particularly to light. α-Benzoylacetanilide couplers provide high color densities.

Magenta couplers which can be used in this invention include oil-protected indazolone or cyanoacetyl couplers, and preferably 5-pyrazolone couplers and pyrazoloazole couplers, such as pyrazolotriazole couplers. The 5-pyrazolone couplers preferably include those having an arylamino group or an acylamino group at the 3-position thereof in view of hues and densities of colors obtained therefrom. Typical examples of such couplers are described, e.g., in U.S. Pat. Nos. 2,311,082, 2,343,703, 2,600,788, 2,908,573, 3,062,653, 3,152,896, and 3,936,015. Preferred releasable groups for 2-equivalent 5-pyrazolone couplers include nitrogen releasable groups as described in U.S. Pat. No. 4,310,619 and arylthio groups as described in U.S. Pat. No. 4,351,897. The 5-pyrazolone couplers having a ballast group as described in European Patent No. 73,636 provide high color densities.

The pyrazoloazole couplers include pyrazolobenzimidazoles as described in U.S. Pat. No. 3,369,879 and preferably pyrazolo[5,1-c][1,2,4]triazoles as described in U.S. Pat. No. 3,725,067, pyrazolotetrazoles as disclosed in *Research Disclosure,* RD No. 24220 (June 1984) and pyrazolopyrazoles as disclosed in *Research Disclosure,* RD No. 24230 (June 1984). From the viewpoint of reduced side absorption of yellow colors and fastness to light, imidazo[1,2-b]pyrazoles disclosed in European Patent No. 119,741 are preferred, and pyrazolo[1,5-b][1,2,4]triazoles disclosed in European Patent No. 119,860 are particularly preferred.

The cyan couplers which can be used in the present invention include oil-protected naphthol and phenol couplers, typically exemplified by the naphthol couplers disclosed in U.S. Pat. No. 2,474,293, and preferably oxygen atom-release type 2-equivalent naphthol couplers described in U.S. Pat. Nos. 4,052,212, 4,146,396, 4,228,233 and 4,296,200; and phenol couplers disclosed in U.S. Pat. Nos. 2,369,929, 2,801,171, 2,772,162 and 2,895,826, etc. Cyan couplers fast to moisture and heat are preferably used in this invention. Typical examples of such couplers include phenol cyan couplers having an alkyl group having 2 or more carbon atoms at the m-position of the phenol nucleus, as described in U.S. Pat. No. 3,772,002; 2,5-diacylamino-substituted phenol couplers as described in U.S. Pat. Nos. 2,772,162, 3,758,308, 4,126,396, 4,334,011 and 4,327,173, West German Patent Publication (OLS) No. 3,329,729, Japanese Patent application No. 42671/83, etc.; phenol couplers having a phenylureido group at the 2-position and an acylamino group at the 5-position, as described in U.S. Pat. Nos. 3,446,622, 4,333,999, 4,451,559 and 4,427,767, etc.; and the like.

In order to correct undesired absorption in the short wavelength region typically shown by the dyes produced from magenta and cyan couplers, it is preferable to use colored couplers in color photographic light-sensitive materials. Typical examples of the colored couplers include yellow-colored magenta couplers as described in U.S. Pat. No. 4,163,670, Japanese Patent Publication No. 39413/82, etc.; magenta-colored cyan couplers as described in U.S. Pat. Nos. 4,004,929 and 4,138,258, British Patent No. 1,146,368, etc.; and the like.

Graininess can be improved by using couplers which produce dyes having moderate diffusibility. Specific examples of such couplers are described in U.S. Pat. No. 4,366,237 and British Patent No. 2,125,570 with respect to magenta couplers; and in European Patent No. 96,570 and West German Patent Publication (OLS) No. 3,234,533 with respect to yellow, magenta and cyan couplers.

The dye forming couplers and the above described special couplers may be present in the form of polymers, inclusive of dimer. Typical examples of polymerized dye forming couplers are described in U.S. Pat. Nos. 3,451,820 and 4,080,211. Specific examples of polymerized magenta couplers are described in British Patent No. 2,102,173 and U.S. Pat. No. 4,367,282.

These couplers may be either 4-equivalent or 2-equivalent with respect to silver ion. They may be colored couplers having color correction effects or couplers which release a development inhibitor with the progress of development (so-called DIR couplers).

In addition to the DIR couplers, the light-sensitive materials may contain colorless DIR coupling compounds which produce a colorless coupling reaction product and release a development inhibitor.

For the purpose of satisfying characteristic requirements of light-sensitive materials, two or more of the above-described various couplers may be incorporated in the same layer, or two or more layers may contain the same kind of couplers.

The couplers of the invention and couplers to be used in combination can be introduced in silver halide emulsion layers by known processes, such as the process disclosed in U.S. Pat. No. 2,322,027. In some detail, the coupler is dissolved in a high-boiling organic solvent, an organic solvent having a boiling point of from about 30° C. to 150° C. or a mixture thereof and the solution is dissolved in a hydrophilic colloid. Examples of the high-boiling organic solvent are alkyl phthalates (e.g., dibutyl phthalate, dioctyl phthalate, etc.), phosphoric esters (e.g., diphenyl phosphate, triphenyl phosphate, tricresyl phosphate, dioctylbutyl phosphate, etc.), citric esters (e.g., tributyl acetylcitrate, etc.), benzoic esters (e.g., octyl benzoate, etc.), alkylamides (e.g., diethyllaurylamide, etc.), fatty acid esters (e.g., dibutoxyethyl succinate, diethyl azelate, etc.), trimesic esters (e.g., tributyl trimesate, etc.), and the like. Examples of the low-boiling organic solvents are lower alkyl acetates, e.g., ethyl acetate, butyl acetate, etc., ethyl propionate, t-butyl alcohol, methyl isobutyl ketone, β-ethoxyethyl acetate, methyl cellosolve acetate, etc.

Incorporation of the coupler may also be carried out by the dispersion method using polymers as described in Japanese Patent Publication No. 39853/76 and Japanese Patent application (OPI) No. 59943/76.

When the coupler has an acid group, such as a carboxyl group, a sulfo group, etc., it is introduced into a hydrophilic colloid as an alkaline aqueous solution.

Binders or protective colloids which can be used in emulsion layers or intermediate layers of the light-sensitive materials include gelatin to advantage, but other hydrophilic colloids may also be used, alone or in combination with gelatin.

The gelatin to be used includes not only lime-processed gelatin, but also acid-processed gelatin. Details of processes for preparing gelatin are described in Arthur Weiss, *The Macromolecular Chemistry of Gelatin,* Academic Press (1964), etc.

Silver halides which can be used in emulsion layers of the photographic light-sensitive materials of this invention may be any of silver bromide, silver iodobromide, silver iodochlorobromide, silver chlorobromide, and silver chloride. A preferred silver halide is silver iodobromide containing not more than 15 mol %, and particularly preferably from 2 to 12 mol %, of silver iodide.

The average grain size of silver halide grains, defined as a grain diameter in the case of spherical or nearly spherical grains or an edge length in the case of cubic grains, and averaged based on the total projected area, is not particularly limited, but is preferably not more than 3 μm.

The grain size distribution may be either narrow or broad.

The silver halide grains may have a regular crystal form, such as a cube, an octahedron, etc , an irregular crystal form, such as a sphere, a plate, etc , or a composite form thereof. Further, the grains having various crystal forms may be used as a mixture. Furthermore, an emulsion in which 50% or more of the silver halide grains based on the total projected area comprises super-flat grains having a diameter at least 5 times its thickness may also be employed.

The silver halide grains may have different phases between the interior and the surface thereof. They may be of the type in which a latent image is predominantly formed on the surface thereof or of the type in which a latent image is predominantly formed in the interior thereof.

The photographic emulsions to be used in the invention can be prepared by known processes as described, e.g., in P. Glafkides, *Chimie et Physique Photographique,* Paul Montel (1966), V.L. Zelikman, et al., *Making and Coating Photographic Emulsion,* The Focal Press (1964), etc. In some detail, the emulsion can be prepared by any of the acid process, the neutral process, the ammonia process, etc. The reaction between soluble silver salts and soluble halogen salts can be effected by any of the single jet process, the double jet process, a combination thereof, and the like. The so-called reverse mixing method, in which grains are formed in the presence of excess silver ions, can be used. Further, the reaction may also be carried out according to the so-called controlled double jet method, in which a pAg value of a liquid phase wherein silver halide grains are formed is maintained constant. This method produces silver halide emulsions having grains of regular crystal form and a nearly uniform size distribution.

Two or more silver halide emulsions separately prepared may be used as a mixture.

During the formation of silver halide grains or physical ripening, a cadmium salt, a zinc salt, a lead salt, a thallium salt, an iridium salt or a complex salt thereof, a rhodium salt or a complex salt thereof, an iron salt or a complex salt thereof, etc., may be present.

The silver halide emulsions are usually subjected to chemical sensitization. Chemical sensitization can be carried out by known processes as described, e.g., in H. Fieser (ed.), *Die Grundlagender Photographischen Prozesse mit Silber Halogeniden,* pp. 675–734, Akademische Verlagsgesellschaft (1968).

More specifically, chemical sensitization can be effected by sulfur sensitization using active gelatin or compounds containing sulfur capable of reacting with silver (e.g., thiosulfates, thioureas, mercapto compounds, rhodanines, etc.); reduction sensitization using a reducing substance (e.g., stannous salts, amines, hydrazine derivatives, formamidinesulfinic acid, silane compounds, etc.); or noble metal sensitization using a noble metal compound (e.g., gold complex salts, complex salts of metals of Group VIII of the Periodic Table, e.g., Pt, Ir, Pd, etc ). Such chemical sensitization techniques can be used alone or in combination.

The photographic emulsions which can be used in the present invention can contain various compounds for the purpose of preventing fog during the preparation, preservation, or photographic processing or stabilizing photographic performances. Such compounds include various kinds of antifoggants or stabilizers, such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds, e.g., oxazolinethione, etc ; azaindenes, e.g., triazaindenes, tetrazaindenes (especially 4-hydroxy-substituted (1,3,3a,7)tetraazaindenes), pentaazaindenes, etc.; benzenethiosulfonic acid, benzenesulfinic acid, benzenesulfonic acid amide, and so on.

The photographic emulsion layers or other hydrophilic colloidal layers of the light-sensitive materials according to the present invention may contain a wide variety of surface active agents for various purposes, such as coating aid, static charge prevention, improvement of slipperiness, emulsification and dispersion aid, prevention of adhesion, improvement of photographic characteristics (e.g., acceleration of development, increase in contrast or increase in sensitivity), and the like.

The photographic emulsion layers of the light-sensitive materials of the invention may further contain polyalkylene oxides or derivatives thereof, such as ethers, esters, amines, etc., thio-ether compounds, thiomorpholines, quaternary ammonium salt compounds, urethane derivatives, urea derivatives, imidazole derivatives, 3-pyrazolidones, and the like for the purpose of increasing sensitivity or contrast or accelerating development.

For the purpose of improving dimensional stability and the like, the photographic emulsion layers or other hydrophilic colloidal layers of the light-sensitive materials of the invention may furthermore contain a dispersion of water-insoluble or sparingly water-soluble synthetic polymers. Such polymers include homopolymers of alkyl acrylates, alkyl methacrylates, alkoxyalkyl acrylates, alkoxyalkyl methacrylate, glycidyl acrylate, glycidyl methacrylate, acrylamide, methacrylamide, vinyl esters (e.g., vinyl acetate), acrylonitrile, olefins, styrene or the like, or copolymers comprising these monomers, and copolymers comprising a combination of these monomers and other monomers, such as acrylic acid, methacrylic acid, $\alpha,\beta$-unsaturated dicarboxylic acids, hydroxyalkyl acrylates, hydroxyalkyl methacrylates, sulfoalkyl acrylates, sulfoalkyl methacrylates, styrenesulfonic acid, etc.

The photographic emulsions to be used in the invention may be spectrally sensitized with methine dyes or others. Sensitizing dyes to be used include cyanine dyes, merocyanine dyes, complex cyanine dyes, complex merocyanine dyes, holopolar cyanine dyes, hemicyanine dyes, styryl dyes, and hemioxonol dyes, with cyanine dyes, merocyanine dyes and complex merocyanine dyes being particularly useful. These dyes may contain any of the nuclei commonly used as basic heterocyclic nuclei in cyanine dyes. Examples of applicable nuclei are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-enumerated nuclei to which an alicyclic hydrocarbon ring is fused; and the above-enumerated nuclei to which an aromatic hydrocarbon ring is fused, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have substituents on their carbon atoms.

The merocyanine dyes or complex merocyanine dyes can have a 5- or 6-membered heterocyclic nucleus as a ketomethylene structure, such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc.

The above-described sensitizing dyes may be used either alone or in combination thereof. A combination of sensitizing dyes is frequently employed for the particular purpose of super-sensitization.

In addition to these sensitizing dyes, the emulsions may contain dyes which do not have per se spectral sensitizing action or substances which do not substantially absorb visible light, but both of which exhibit supersensitization activity. Such dyes or substances include aminostyryl compounds substituted with a nitrogen-containing heterocyclic group as disclosed in U.S. Pat. Nos. 2,933,390 and 3,635,721; aromatic organic acid-formaldehyde condensation products as disclosed in U.S. Pat. No. 3,743,510, cadmium salts, azaindene compounds, and the like.

The photographic emulsion layers and other hydrophilic colloidal layers of the light-sensitive materials of the invention can contain organic or inorganic hardening agents, such as chromium salts (e.g., chromium alum, chromium acetate, etc.), aldehydes (e.g. formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. and combinations thereof.

When hydrophilic colloidal layers of the light-sensitive materials contain dyes or ultraviolet absorbents, the layers may be mordanted with cationic polymer, etc.

The light-sensitive materials of the invention may contain color fog preventing agents, such as hydroquinone derivatives, aminophenol derivatives, gallic acid derivatives, ascorbic acid derivatives, etc.

The hydrophilic colloidal layers can contain ultraviolet absorbents. Examples of the ultraviolet absorbents to be used include benzotriazole compounds substituted with an aryl group as described in U.S. Pat. No. 3,533,794, 4-thiazolidone compounds as described in U.S. Pat. Nos. 3,314,794 and 3,352,681, benzophenone compounds as described in Japanese Patent application (OPI) No. 2784/71, cinnamic ester compounds as described in U.S. Pat. Nos. 3,705,805 and 3,707,375, butadiene compounds as described in U.S. Pat. No. 4,045,229 and benzoxazole compounds as described in U.S. Pat. No. 3,700,455. Ultraviolet absorbing couplers, such as $\alpha$-naphthol cyan forming couplers, or ultraviolet absorbing polymers may also be employed. These ultraviolet absorbents may be fixed to a specific layer by mordanting.

The light-sensitive materials of the invention may contain water-soluble dyes in their hydrophilic colloidal layers as filter dyes or for other various purposes, such as prevention of irradiation. Such dyes include oxonol dyes, hemioxonol dyes, styryl dyes, merocyanine dyes, cyanine dyes and azo dyes, with oxonol dyes, hemioxonol dyes, and merocyanine dyes being particularly useful.

In carrying out the present invention, known discoloration inhibitors can be used, including hydroquinone derivatives, gallic acid derivatives, p-alkoxyphenols, p-hydroxyphenol derivatives, bisphenols, and the like. The dye image stabilizers can be used individually or in combinations of two or more thereof.

Methods of photographic processing of the light-sensitive materials according to the present invention and the processing solutions to be used therefor are conventional, and any of known methods and processing solutions as described, e.g., in Research Disclosure, RD No. 176, pp. 28–30 can be applied. The processing temperature is usually selected from between 18° and 50° C., but temperatures lower than 18° C. or higher than 50° C. may also be used.

Color developers to be employed generally comprise an alkaline aqueous solution containing a color developing agent. The color developing agent includes known aromatic primary amine developing agents, such as phenylenediamines, e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.

In addition, other color developing agents as disclosed in F.A. Mason, *Photographic Processing Chemistry*, pp. 226-229, The Focal Press (1966), U.S. Pat. Nos. 2,193,015 and 2,592,364, Japanese Patent application (OPI) No. 64933/73, etc., are also applicable.

The color developers can further contain buffer agents, such as sulfites, carbonates, borates or phosphates of alkali metals; development restrainers or antifoggants, such as bromides, iodides, and organic antifoggants; and the like. If desired, the color developers may contain other additives, such as water softeners, preservatives (e.g., hydroxylamine), organic solvents (e.g., benzyl alcohol, diethylene glycol), development accelerators (e.g., polyethylene glycol, quaternary ammonium salts, amines), color forming couplers, competing couplers, fogging agents (e.g., sodium boron hydride), auxiliary developing agents (e.g., 1-phenyl-3-pyrazolidone), viscosity-imparting agents, polycarboxylic acid chelating agents, antioxidants, and the like.

The photographic emulsion layers after color development are usually subjected to bleaching. Bleaching may be carried out either simultaneously with or independently of fixing. Bleaching agents that can be used include compounds of polyvalent metals, e.g., iron (III), cobalt (III), chromium (VI), copper (II), etc., peracids, quinones, nitroso compounds, and the like.

Specific examples of these bleaching agents include ferricyanides; bichromates; organic complex salts of iron (III) or (cobalt), such as complex salts with aminopolycarboxylic acids, e.g., ethylenediaminetetraacetic acid, nitrilotriacetic acid, 1,3-diamino-2-propanoltetraacetic acid, etc.; organic acids, e.g., citric acid, tartaric acid, maleic acid, etc.; persulfates, permanganates; nitrosophenol, etc. Of these, potassium ferricyanide, sodium (ethylenediaminetetraacetato) iron (III) and ammonium (ethylenediaminetetraacetato) iron (III) are particularly useful. Iron (III) ethylenediaminetetraacetate complex salts are useful in either an independent bleaching bath or a combined bleaching and fixing bath.

The fixing solution to be used has a commonly employed composition. Fixing agents include not only thiosulfates and thiocyanates but organic sulfur compounds known to have fixing effects. The fixing solution may contain water-soluble aluminum salts as hardening agents.

After the fixing or bleach-fix processing the light-sensitive material is generally subjected to washing or stabilizing processing. In a simplified method, only washing processing is carried out, or only stabilizing processing is conducted without a substantial washing step, as suggested in Japanese Patent application (OPI) No. 8543/82.

Water to be used in the washing can contain, if necessary, known additives, such as chelating agents, e.g., inorganic phosphoric acids, aminopolycarboxylic acids, organic phosphoric acids, etc.; bactericides for preventing proliferation of various bacteria or algae; hardening agents, e.g., magnesium salts, aluminum salts, etc.; surface active agents for reducing drying load or preventing uneven drying; and so on. In addition, the compounds described in L.E. West, *Water Quality Criteria, Phot. Sci and Eng.*, Vol. 9, No. 6, pp. 344–359 (1965), etc., can also be used.

If desired, the washing can be effected by using a plurality of tanks, and water may be saved by countercurrent washing using multiple stages, e.g., 2 to 9 stages.

The processing solution to be used in the stabilizing step is a stabilizer for stabilizing a dye images, such as a solution having a buffer capacity to maintain at a pH of from 3 to 6, a solution containing an aldehyde (e.g., formaldehyde), and the like. If desired, the stabilizer may contain additives, such as fluorescent brightening agents, chelating agents, bactericides, hardening agents, surface active agents, and the like.

The stabilizing step may be effected by using a plurality of tanks, if desired. The stabilizer can be saved by countercurrent stabilizing in multiple stages, e.g., 2 to 9 stages. When the stabilizing step is conducted, the washing step may be omitted.

This invention will now be illustrated in greater detail by way of the following examples, but it should be understood that the present invention is not deemed to be limited thereto.

EXAMPLE 1

A multilayer color light-sensitive material was prepared by coating the following layers on a polyethylene terephthalate film support.

| | | |
|---|---|---|
| 1st Layer (Antihalation Layer): | | |
| A gelatin layer containing black colloidal silver. | | |
| 2nd Layer (Intermediate Layer): | | |
| A gelatin layer containing a dispersion of 2,5-di-t-octylhydroquinone. | | |
| 3rd Layer (First Red-Sensitive Emulsion Layer) | | |
| Silver iodobromide emulsion layer (silver iodide: 5 mol %) | 1.6 | g-Ag/m$^2$ |
| Sensitizing Dye I | $4.5 \times 10^{-4}$ | mol/mol-Ag |
| Sensitizing Dye II | $1.5 \times 10^{-4}$ | mol/mol-Ag |
| Coupler EX-1 | 0.03 | mol/mol-Ag |
| Coupler EX-3 | 0.003 | mol/mol-Ag |
| Coupler EX-9 | 0.002 | mol/mol Ag |
| 4th Layer (Second Red-Sensitive Emulsion Layer) | | |
| Silver iodobromide emulsion layer (silver iodide: 10 mol %) | 1.4 | g-Ag/m$^2$ |
| Sensitizing Dye I | $3 \times 10^{-4}$ | mol/mol-Ag |
| Sensitizing Dye II | $1 \times 10^{-4}$ | mol/mol-Ag |
| Coupler EX-1 | 0.002 | mol/mol-Ag |
| Coupler EX-2 | 0.02 | mol/mol-Ag |
| Coupler EX-3 | 0.0016 | mol/mol Ag |
| 5th Layer (Intermediate Layer): | | |
| The same as the 2nd layer. | | |
| 6th Layer (First Green-Sensitive Emulsion Layer) | | |
| Silver iodobromide emulsion layer (silver iodide: 6 mol %) | 1.8 | g-Ag/m$^2$ |
| Sensitizing Dye III | $5 \times 10^{-4}$ | mol/mol-Ag |
| Sensitizing Dye IV | $2 \times 10^{-4}$ | mol/mol-Ag |
| Coupler EX-4 | 0.05 | mol/mol-Ag |
| Coupler EX-5 | 0.008 | mol/mol-Ag |
| Coupler EX-9 | 0.003 | mol/mol Ag |
| 7th Layer (Second Green-Sensitive Emulsion Layer) | | |
| Silver iodobromide emulsion layer (silver iodide: 8 mol %) | 1.3 | g-Ag/m$^2$ |
| Sensitizing Dye III | $3 \times 10^{-4}$ | mol/mol-Ag |
| Sensitizing Dye IV | $1.2 \times 10^{-4}$ | mol/mol-Ag |
| Coupler EX-7 | 0.017 | mol/mol-Ag |
| Coupler EX-6 | 0.003 | mol/mol-Ag |
| 8th Layer (Yellow Filter Layer): | | |
| A gelatin layer comprising a gelatin aqueous solution containing yellow colloidal silver and a dispersion of 2,5-di-t-octylhydroquinone. | | |
| 9th Layer (First Blue-Sensitive Emulsion Layer) | | |
| Silver iodobromide emulsion layer (silver iodide: 6 mol %) | 0.7 | g-Ag/m$^2$ |
| Coupler EX-8 | 0.25 | mol/mol-Ag |
| Coupler EX-14 | 0.010 | mol/mol-Ag |
| 10th Layer (Second Blue-Sensitive Emulsion Layer) | | |
| Silver iodobromide emulsion layer (silver iodide: 6 mol %) | 0.6 | g-Ag/m$^2$ |
| Coupler EX-8 | 0.06 | mol/mol-Ag |
| 11th Layer (First Protective Layer): | | |
| Non-light sensitive silver iodobromide (silver iodide: 1 mol %; mean grain size: 0.07 μm) | 0.5 | g-Ag/m$^2$ |
| A gelatin layer containing a dispersion of Ultraviolet Absorbent UV-1. | | |
| 12th Layer (Second Protective Layer): | | |
| A gelatin layer containing polymethyl methacrylate particles (diameter: ca. 1.5 μm) | | |

Each of the above layers contained Gelatin Hardener H-1 and a surface active agent in addition to the above-described components. The thus prepared light-sensitive material was designated as Sample 101.

Samples 102 to 111 were prepared in the same manner as for Sample 101 except for changing Coupler EX-9 and its amount in the first red-sensitive emulsion layer (low-sensitive emulsion layer) and the first green-sensitive emulsion layer (low-sensitive emulsion layer) as shown in Table 1.

Each of Samples 101 to 111 was wedgewise exposed to white light and processed as described below. As a result, each of the processed samples showed substantially equal sensitivity and gradation. Sharpness of each processed sample was evaluated by way of the MTF (modulation transfer function) value (a value at a certain spatial frequency point on an MTF curve) at a spatial frequency of 25 c/mm. The results obtained are also shown in Table 1.

The compounds used in the preparation of the samples are shown below.

Coupler

EX-1

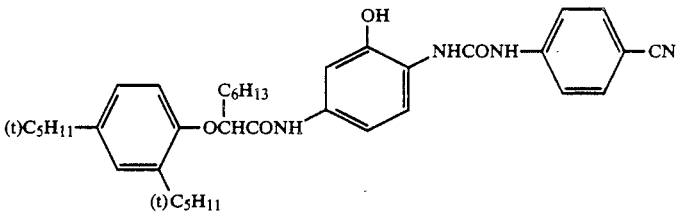

EX-2

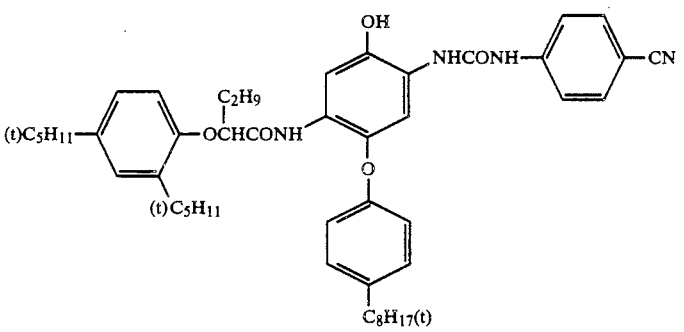

EX-3

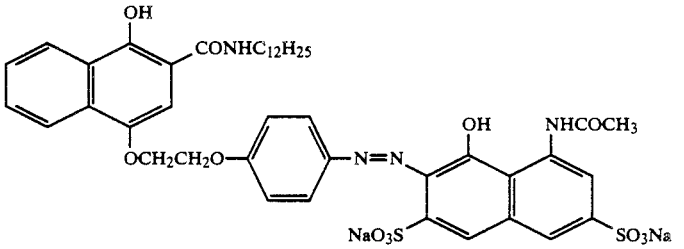

EX-4

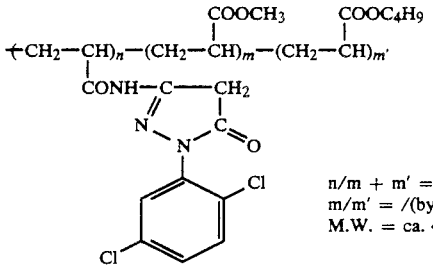

n/m + m' = /(by weight)
m/m' = /(by weight)
M.W. = ca. 40,000

EX-5

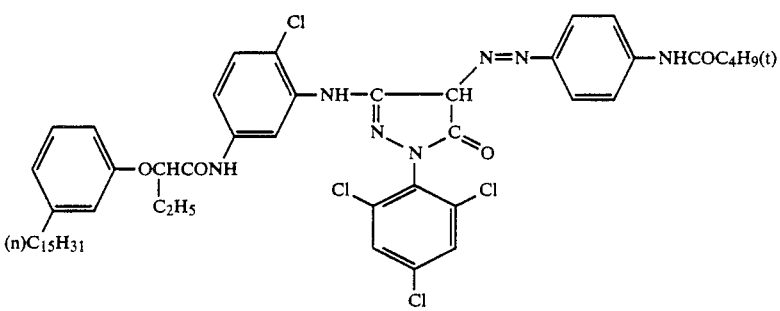

-continued
EX-6
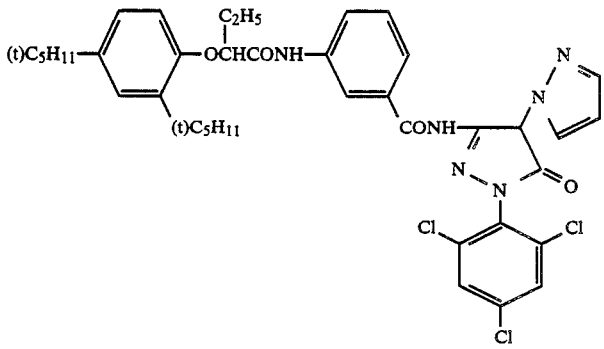
EX-7
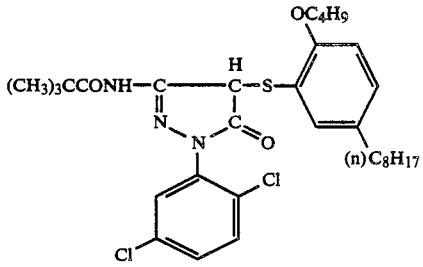
$(t)C_8H_{17}$: $(CH_3)_3CCH_2C(CH_3)_2$—
EX-8
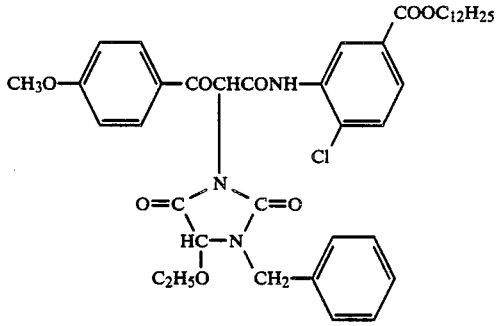
(disclosed in U.S. Pat. No. 4,421,845)
EX-9
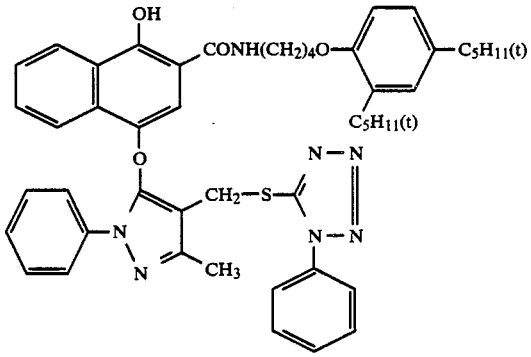

-continued
(disclosed in U.S. Pat. No. 4,248,962) EX-10
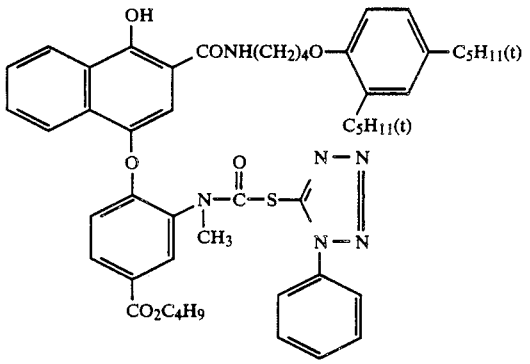
(disclosed in U.S. Pat. No. 4,248,962) EX-11
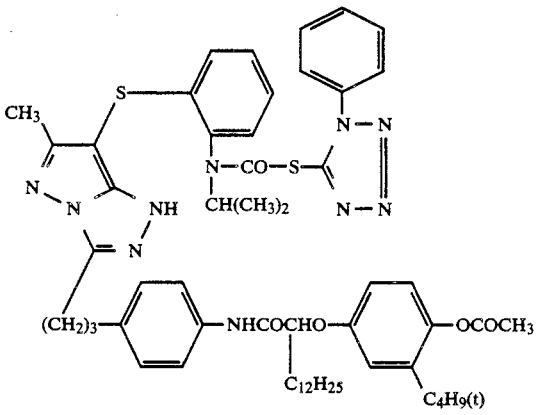
(disclosed in U.S. Pat. No. 4,144,071) EX-12
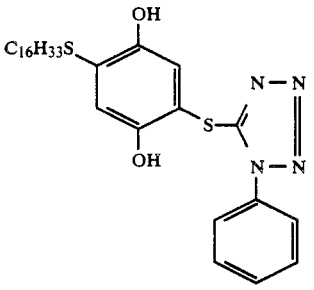
(disclosed in U.S. Pat. No. 4,438,193) EX-13
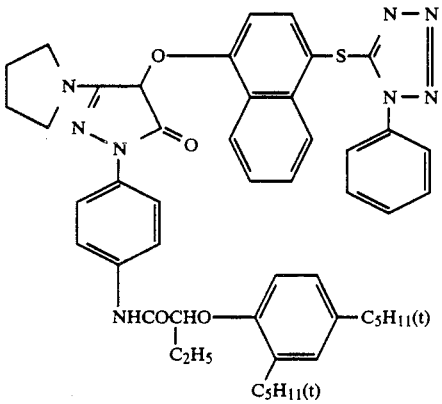

-continued
EX-14
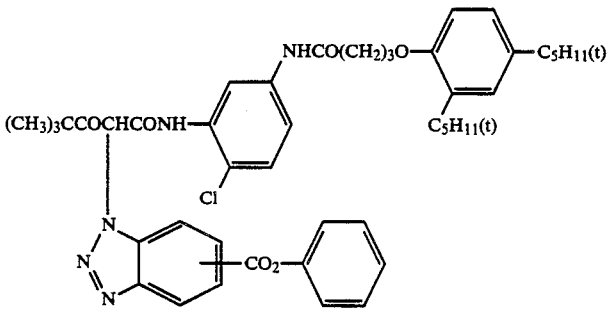
H-1
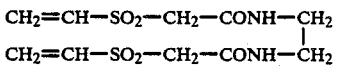
UV-1
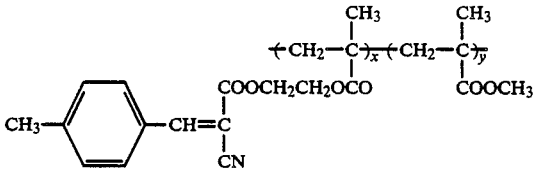
x/y = 7/3 (by weight)
Sensitizing Dye I
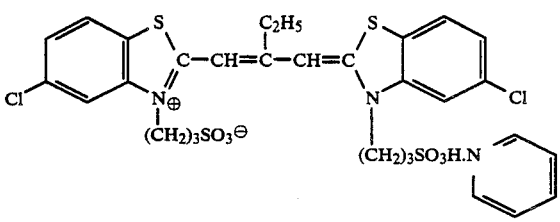
Sensitizing Dye II
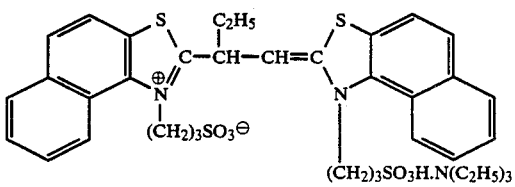
Sensitizing Dye III
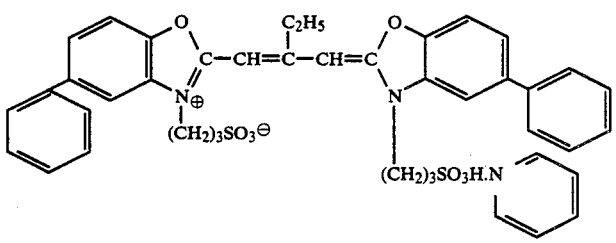
Sensitizing Dye IV
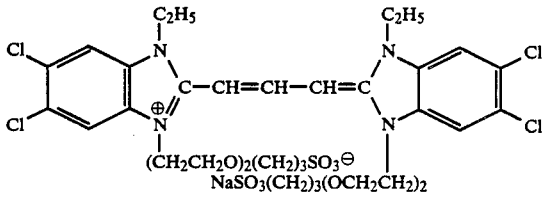
The development processing was carried out in accordance with the following steps at 38° C.
| | |
|---|---|
| Color Development | 3 min. 15 sec. |
| Bleaching | 6 min. 30 sec. |
-continued
| | |
|---|---|
| Washing | 2 min. 10 sec. |
| Fixing | 4 min. 20 sec. |
| Washing | 3 min. 15 sec. |

-continued

| Stabilization | 1 min. 5 sec. |
|---|---|

The processing solution used in each processing step had the following formulation:

| | |
|---|---|
| Color Developer: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hyroxyethylamino)-2-methylaniline sulfate | 4.5 g |
| Water to make | 1.0 liter (pH = 10.0) |
| Bleaching Solution: | |
| Ammonium (ethylenediaminetetra-acetato)ferrite | 100.0 g |
| Disodium ethylenediaminetetraacetate | 10.0 g |
| Ammonium bromide | 150.0 g |
| Ammonium nitrate | 10.0 g |
| Water to make | 1 liter (pH = 6.0) |
| Fixing Solution: | |
| Disodium ethylenediaminetetraacetate | 1.0 g |
| Sodium sulfite | 4.0 g |
| Ammonium thiosulfate aqueous solution (70 wt %) | 175.0 ml |
| Sodium bisulfite | 4.6 g |
| Water to make | 1.0 liter (pH = 6.6) |
| Stabilizer: | |
| Formaldehyde (40 wt %) | 2.0 ml |
| Polyoxyethylene-p-monononylphenyl ether (average degree of polymerization: ca. 10) | 0.3 g |
| Water to make | 1.0 liter |

TABLE 1

| Sample No. | DIR Compound in First Red-Sensitive Layer Kind | Amount* | DIR Compound in First Green-Sensitive Layer Kind | Amount* | MTF Value Red-Sensitive Layer | Green-Sensitive Layer | Remark |
|---|---|---|---|---|---|---|---|
| 101 | EX-9 | 1.0 | EX-9 | 1.0 | 0.52 | 0.61 | Comparison |
| 102 | EX-10 | 1.0 | EX-10 | 1.0 | 0.52 | 0.60 | " |
| 103 | EX-9 | 1.0 | EX-11 | 1.5 | 0.49 | 0.60 | " |
| 104 | EX-12 | 1.0 | EX-12 | 1.0 | 0.51 | 0.60 | " |
| 105 | EX-10 | 1.0 | EX-13 | 1.5 | 0.51 | 0.61 | " |
| 106 | (1) | 1.0 | (1) | 1.0 | 0.58 | 0.67 | Invention |
| 107 | (2) | 2.0 | (2) | 2.0 | 0.60 | 0.69 | " |
| 108 | (3) | 1.0 | (51) | 1.0 | 0.57 | 0.67 | " |
| 109 | (4) | 2.0 | (52) | 1.0 | 0.59 | 0.67 | " |
| 110 | (7) | 1.0 | (55) | 1.0 | 0.57 | 0.68 | " |
| 111 | (17) | 2.5 | (27) | 1.5 | 0.59 | 0.68 | " |

Note:
*Molar ratio to EX-9 in Sample 101.

It is apparent from the results of Table 1 above that the compounds according to the present invention, when used in both the green-sensitive layer and the red-sensitive layer, markedly improve sharpness over the conventional compounds.

Further, the unprocessed film each of Samples 101 to 111 was cut to a width of 35 mm and used for photography with an ordinary camera. The film was subjected to the same development processing as described above and printed on Fuji Color High-Tech 12 Paper (produced by Fuji Photo Film Co., Ltd.) to obtain color prints. When the resulting color prints were visually compared, samples according to the present invention, particularly Samples 108, 109 and 110, had bright colors with no color cloudiness, indicating superiority of the present invention in color reproducibility.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one red-sensitive silver halide emulsion layer, at least one green-sensitive silver halide emulsion layer, and at lest one blue-sensitive silver halide emulsion layer, wherein at least one red-sensitive silver halide emulsion layer and at least one green-sensitive silver halide emulsion layer each contains a precursor compound capable of releasing a compound upon reacting with an oxidation product of a developing agent, and said released compound releases a development inhibitor group upon further reacting with another molecule of the oxidation product of the developing agent, wherein said precursor compound which releases a compound upon reacting with an oxidation of product of a developing agent is represent by formula (I):

$$A—(L_1)_v—B—(L_2)_w—DI \quad (I)$$

wherein A represents a group which releases $(L_l)_v$—B—$(L_2)_w$—DI upon reacting with an oxidation product of a developing agent; $L_1$ represents a group which releases B—$(L_2)_w$—DI after being released from A; B releases a group which releases $(L_2)_w$—DI upon reacting with an oxidation product of a developing agent after being released form A—$(L_1)_v$: $L_2$ represents a group which releases DI after being released from B; DI represents a development inhibitor group; and v and w each represents 0 or 1, and wherein the group B is an oxidation-reduction group represented by the formula (B-1):

$$*—P—(X'=Y')_n—Q—A_2 \quad (B—1)$$

wherein * indicates a position for bonding to A—$(L_1)_v$; X' and Y' each represent a substituted or unsubstituted methine group or a nitrogen group, provided that at least one of time is a methine group substituted with $(L_2)_w$—DI; and any two of $A_2$, P, Q, X' and Y' may be linked together to form a cyclic structure; $A_2$ represents a hydrogen atom or a group releasable by an alkali; P and Q each represents an oxygen atom or a substituted or unsubstituted imino group; and n represents an integer of from 1 to 3.

2. A silver halide color photographic light-sensitive material as in claim 1, wherein A represents a coupler residue or an oxidation-reduction group.

3. A silver halide color photographic light-sensitive material as in claim 2, wherein A represents a coupler residue represented by formula (Cp-1)

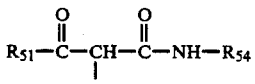

(Cp-1)

wherein $R_{51}$ represents an aliphatic group, an aromatic group, an alkoxy group, or a heterocyclic group; and $R_{52}$ represents an aromatic group or a heterocyclic group; a coupler residue represented by formula (Cp-2)

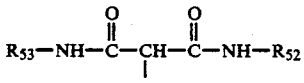

(Cp-2)

wherein $R_{52}$ is as defined above; and $R_{53}$ represents an aromatic group or a heterocyclic group; a coupler residue represented by formula (Cp-3)

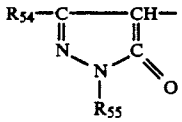

(Cp-3)

wherein $R_{54}$ represents a hydrogen atom, a substituted or unsubstituted straight chain or branched chain alkyl group, a substituted or unsubstituted alkenyl group, a substituted or unsubstituted cyclic alkyl group, a substituted or unsubstituted aralkyl group or a substituted or unsubstituted cyclic alkenyl group having 1 to 32 carbon atoms, a substituted or unsubstituted aryl group, a substituted or unsubstituted heterocyclic group, an alkoxycarbonyl group, an aryloxycarbonyl group, an aralkyloxycarbonyl group, an alkoxy group, an aryloxy group, an alkylthio group, an arylthio group, a carboxyl group, an acylamino group, a diacylamino group, an N-alkylacylamino group, an N-arylacylamino group, a substituted or unsubstituted ureido group, an urethane group, a thiourethane group, an arylamino group, an alkylamino group, a cycloamino group, a heterocyclic amino group, an alkylcarbonyl group, an arylcarbonyl group, a substituted or unsubstituted sulfonamido group, a substituted or unsubstituted carbamoyl group, a substituted or unsubstituted sulfamoyl group, a cyano group, a hydroxyl group or a sulfo group, and $R_{55}$ represents a substituted or unsubstituted straight chain or branched alkyl group, a substituted or unsubstituted alkenyl group, a substituted or unsubstituted cyclic alkyl group, a substituted or unsubstituted aralkyl group or a substituted or unsubstituted cyclic alkenyl group having from 1 to 32 carbon atoms, or a substituted or unsubstituted aryl group, a substituted or unsubstituted heterocyclic group, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group; a coupler residue represented by formula (Cp-4)

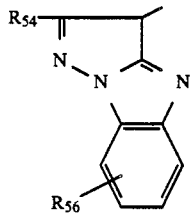

(Cp-4)

wherein $R_{54}$ is as defined above; and $R_{56}$ represents a hydrogen atom, a substituted or unsubstituted, straight chain or branched alkyl, alkenyl, cyclic alkyl, aralkyl, or cyclic alkenyl group having form 1 to 32 carbon atoms, a substituted or unsubstituted aryl group, a substituted or unsubstituted heterocyclic group, a cyano group, an alkoxy group, an aryloxy group, a halogen atom, a carboxyl group, an alkoxycarbonyl group, an aryloxycarbonyl group, an acyloxy group, a sulfo group, a sulfamoyl group, a carbamoyl group, an acylamino group, a diacylamino group, an ureido group, an urethane group, a sulfonamido group, an arylsulfonyl group, an alkylsulfonyl group, an arylthio group, an alkylthio group, an alkylamino group, a idalkylamino group, an anilino group, an N-arylanilino group, an N-alkylanilino group, an N-acylanilino group or a hydroxyl group; a coupler residue represented by formula (Cp-5)

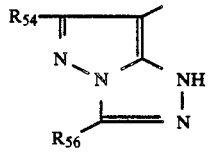

(Cp-5)

wherein $R_{54}$ and $R_{56}$ are as defined above; a coupler residue represented by formula (Cp-6)

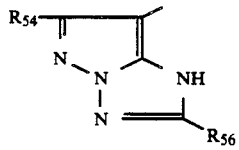

(Cp-6)

wherein $R_{54}$ and $R_{56}$ are as defined above; a coupler residue represented by formula (Cp-7)

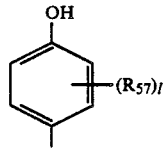

(Cp-7)

wherein $R_{57}$ represents a hydrogen atom, a halogen atom, an alkoxycarbonylamino group, a substituted or unsubstituted aliphatic hydrocarbon residue, a substituted or unsubstituted N-arylureido group, an acylamino group, —O—$R_{62}$ or —S— $R_{62}$, wherein $R_{62}$ represents a substituted or unsubstituted aliphatic hydrocarbon residue; and l represents an integer of from 1 to 4; when l is 2 or more, the plurality of $R_{57}$ groups are the same or different; a coupler residue represented by formula (Cp-8)

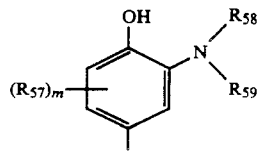

(Cp-8)

wherein $R_{57}$ is as defined above; $R_{58}$ and $R_{59}$ each represents a hydrogen atom, a substituted or unsubstituted aliphatic hydrocarbon residue, a substituted or unsubstituted aryl group or a substituted or unsubstituted heterocyclic group, provided that both $R_{58}$ and $R_{59}$ do not simultaneously represent a hydrogen atom, or $R_{58}$ and $R_{59}$ together form a nitrogen-containing heterocyclic ring, and m represents an integer of from 1 to 3; a coupler residue represented by formula (Cp-9)

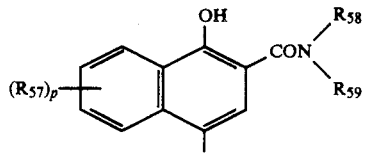

(Cp-9)

wherein $R_{57}$, $R_{58}$, and $R_{59}$ are as defined above; and p represents an integer of from 1 to 5; a coupler residue represented by formula (Cp-10)

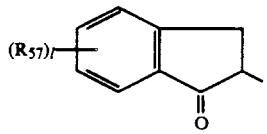

(Cp-10)

wherein $R_{57}$ and l are as defined above; or a coupler residue represented by formula (Cp-11)

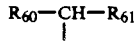

(Cp-11)

wherein $R_{60}$ represents a substituted or unsubstituted arylcarbonyl group, a substituted or unsubstituted alkanoyl group having from 2 to 32 carbon atoms, a substituted or unsubstituted arylcarbamoyl group, a substituted or unsubstituted alkanecarbamoyl group having from 2 to 32 carbon atoms, a substituted or unsubstituted alkoxycarbonyl group having from 1 to 32 carbon atoms or a substituted or unsubstituted aryloxycarbonyl group; and $R_{61}$ represents a substituted or unsubstituted arylcarbonyl group, a substituted or unsubstituted alkanoyl group having from 2 to 32 carbon atoms, a substituted or unsubstituted arylcarbamoyl group, a substituted or unsubstituted alkanecarbamoyl group having from 2 to 32 carbon atoms, a substituted or unsubstituted alkoxycarbonyl group having from 1 to 32 carbon atoms, a substituted or unsubstituted aryloxycarbonyl group, a substituted or unsubstituted alkylsulfonyl group having from 1 to 32 carbon atoms, a substituted or unsubstituted arylsulfonyl group, a substituted or unsubstituted aryl group or a substituted or unsubstituted 5- or 6-membered heterocyclic group having a nitrogen atom, an oxygen atom, or a sulfur atom as a hetero atom; and the free bond extending from the coupling position in the coupler residue of formulae (Cp-1) to (Cp-11) indicates a position at which a coupling releasable group is bonded.

4. A silver halide color photographic light-sensitive material as in claim 3, wherein said coupler residue is a yellow coupler residue represented by the formula (Cp-1) wherein $R_{51}$ represents a t-butyl group or a substituted or unsubstituted aryl group; and $R_{52}$ represents a substituted or unsubstituted aryl group, or the formula (Cp-2) wherein $R_{52}$ and $R_{53}$ each represents a substituted or unsubstituted aryl group; or a magenta coupler residue represented by the formula (Cp-3) wherein $R_{54}$ represents an acylamino group, an ureido group or an arylamino group; and $R_{55}$ represents a substituted aryl group, the formula (Cp-4) wherein $R_{54}$ represents an acylamino group, an ureido group, or an arylamino group; and $R_{56}$ represents a hydrogen atom, the formula (Cp-5) wherein $R_{54}$ and $R_{56}$ each represents a straight or branched chain alkyl group, an alkenyl group, a cyclic alkyl group, an aralkyl group, or a cyclic alkenyl group, or the formula (Cp-6) wherein $R_{54}$ and $R_{56}$ each represents a straight or branched chain alkyl group, an alkenyl group, a cyclic alkyl group, an aralkyl group or a cyclic alkenyl group; a cyan coupler residue represented by the formula (Cp-7) wherein $R_{57}$ represents an acylamino or ureido group at the 2-position, an acylamino or alkyl group at the 5-position, and a hydrogen or chlorine atom at the 6position, or the formula (Cp-9) wherein $R_{57}$ represents a hydrogen atom, an acylamino group, a sulfonamido group, or an alkoxycarbonyl group at the 5-position; $R_{58}$ represents a hydrogen atom; and $R_{59}$ represents a phenyl group, an alkyl group, an alkenyl group, a cyclic alkyl group, an aralkyl group or a cyclic alkenyl group; or a colorless coupler residue represented by the formula (Cp-10) wherein $R_{57}$ represents an acylamino group, a sulfonamido group, or a sulfamoyl group, or the formula (Cp-11) wherein $R_{60}$ and $R_{61}$ each represents an alkoxycarbonyl group.

5. A silver halide color photographic light-sensitive material as in claim 2, wherein A represents an oxidation-reduction group represented by formula (II):

$$A_1—P—(X=Y)_n—Q—A_2$$

wherein P and Q each represents an oxygen atom or a substituted or unsubstituted imino group; X and Y each represents a substituted or unsubstituted methine group or a nitrogen group, provided that at least one of the X group or groups and the Y group or groups represents a methine group substituted with $(L_1)_v—B—(L_2)_w—DI$; n represents an integer of from 1 to 3; when n is 2 or 3, the plurality of X or the plurality of Y may be the same or different; and $A_1$ and $A_2$ each represents a hydrogen atom or a group releasable by an alkali; any two of P, X, Y, Q, $A_1$ and $A_2$ may be linked together to form a cyclic structure.

6. A silver halide color photographic light-sensitive material as in claim 5, wherein the imino group as represented by P or Q is a sulfonyl-substituted imino group or an acyl-substituted imino group represented by formula (N-1) or formula (N-2), respectively

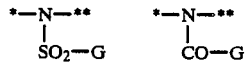

(N-1) (N-2)

wherein * indicates a position for bonding to $A_1$ or $A_2$ of formula (II); ** indicates a position for bonding to one of the free bonds of $-(X=Y)_n-$ of the formula (II); and G represents a straight chain, branched, or cyclic, saturated or unsaturated, and substituted or unsubstituted aliphatic group having from 1 to 32 carbon atoms, a substituted or unsubstituted aromatic group having from 6 to 10 carbon atoms or a 4- to 7-membered heterocyclic group having a nitrogen, sulfur, and oxygen atoms as a hetero atom.

7. A silver halide color photographic light-sensitive material as in claim 5, wherein in Formula (II) P represents an oxygen atom; and $A_2$ represents a hydrogen atom.

8. A silver halide color photographic light-sensitive material as in claim 5, wherein at least one of the X group or groups and the Y group or groups represents a methine group substituted with $(L_1)$ —B—$(L_2)$ —DI, with the remainder thereof being a substituted or unsubstituted methine group.

9. A silver halide color photographic light-sensitive material as in claim 5, wherein said oxidation-reduction group is represented by formula (III) or formula (IV)

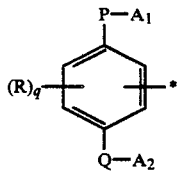

(III)

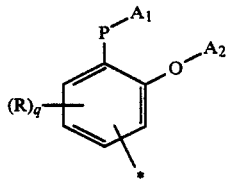

(IV)

wherein * indicates a position at which $(L_1)_v$—B—$(L_2)_w$—DI is bonded; P, Q, $A_1$ and $A_2$ are the same as defined in claim 6; R represents a cyano group, an alkoxycarbonylamino group, an aliphatic hydrocarbon group, an N-arylureido group, an acylamino group, an alkoxy group, an aryloxy group, an alkylthio group or an arylthio group; and q represents an integer of from 0 to 3; and when q is 2 or more, the groups R are the same or different; when two groups R are on carbon atoms adjacent to each other, they may be linked together to form a cyclic structure.

10. A silver halide color photographic light-sensitive material as in claim 1, wherein B represents a group which is released from A—$(L_1)_v$ to form a coupler or a group which is released from A—$(L_1)_v$ to form an oxidation-reduction group.

11. A silver halide color photographic light-sensitive material as in claim 1, wherein P represents an oxygen atom; and Q represents an oxygen atom or a group represented by formula (N-1) or formula (N-2)

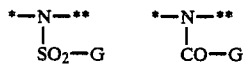

(N-1) (N-2)

wherein * indicates a position for bonding to —(X'=Y')—; ** indicates a position for bonding to $A_2$; and G represents a straight chain, branched, or cyclic, saturated or unsaturated, and substituted or unsubstituted aliphatic group having from 1 to 32 carbon atoms, a substituted or unsubstituted aromatic group having from 6 to 10 carbon atoms or a 4- to 7-membered heterocyclic group having a nitrogen, sulfur, and oxygen atoms as a hetero atom.

12. A silver halide color photographic light-sensitive material as in claim 10, wherein B is represented by formula (B-2) or formula (B-3)

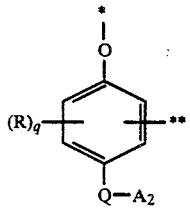

(B-2)

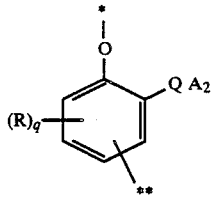

(B-3)

wherein * indicates a position for bonding to A—$(L_1)_v$—; ** indicates a position for bonding to $(L_2)_w$—DI; R represents a cyano group, an alkoxycarbonylamino group, an aliphatic hydrocarbon group, an N-arylureido group, an acylamino group, an alkoxy group, an aryloxy group, an alkylthio group or an arylthio group; q represents an integer of from 0 to 3 and when q is 2 or more, the groups R are the same or different and when two groups R are on carbon atoms adjacent to each other, they may be linked together to form a cyclic structure; Q represents an oxygen atom or a substituted or unsubstituted imino group; and $A_2$ represents a hydrogen atom or a group releasable by alkali, and Q and $A_2$ may be linked together to form a cyclic structure.

13. A silver halide color photographic light-sensitive material as in claim 1, wherein v and w each represents O.

14. A silver halide color photographic light-sensitive material as in claim 1, wherein said precursor compound capable of releasing a compound upon reacting with an oxidation product of a developing agent is present in a layer in an amount of from $1\times10^{-7}$ to 0.5 mol per mol of silver present in the same layer or in an adjacent layer.

15. A silver halide color photographic light-sensitive material as in claim 14, wherein said precursor compound capable of releasing a compound upon reacting with an oxidation product of a developing agent is present in a layer in an amount of from $1\times10^{-6}$ to $1\times10^{-1}$ mol per mol of silver present in the same layer or in an adjacent layer.

16. A silver halide color photographic light-sensitive material as in claim 3, wherein said precursor compound capable of releasing a compound upon reacting with an oxidation product of a developing agent is present in a layer in an amount of from $1\times10^{-7}$ to 0.5 mol per mol of silver present in the same layer or in an adjacent layer.

17. A silver halide color photographic light-sensitive material as in claim 16, wherein said precursor compound capable of releasing a compound upon reacting with an oxidation product of a developing agent is present in a layer in an amount of from $1\times10^{-6}$ to $1\times10^{-1}$ mol per mol of silver present in the same layer or in an adjacent layer.

18. A silver halide color photographic light-sensitive material as in claim 5, wherein said precursor compound capable of releasing a compound upon reacting with an oxidation product of a developing agent is present in a layer in an amount of form $1\times10^{-7}$ to 0.5 mol per mol of silver present in the same layer or in an adjacent layer.

19. A silver halide color photographic light-sensitive material as in claim 18, wherein said precursor compound capable of releasing a compound upon reacting with an oxidation product of a developing agent is present in a layer in an amount of from $1\times10^{-6}$ to $1\times10^{-1}$ mol per mol of silver present in the same layer or in an adjacent layer.

* * * * *